US010322423B2

(12) United States Patent
Walker et al.

(10) Patent No.: US 10,322,423 B2
(45) Date of Patent: Jun. 18, 2019

(54) ROTARY NOZZLE

(71) Applicant: Rain Bird Corporation, Azusa, CA (US)

(72) Inventors: Samuel C. Walker, Green Valley, AZ (US); Lee James Shadbolt, Tucson, AZ (US); David Eugene Robertson, Glendora, CA (US)

(73) Assignee: Rain Bird Corporation, Azusa, CA (US)

( * ) Notice: Subject to any disclaimer, the term of this patent is extended or adjusted under 35 U.S.C. 154(b) by 0 days.

(21) Appl. No.: 15/359,286

(22) Filed: Nov. 22, 2016

(65) Prior Publication Data

US 2018/0141060 A1 May 24, 2018

(51) Int. Cl.

| | |
|---|---|
| ***B05B 3/04*** | (2006.01) |
| ***B05B 3/00*** | (2006.01) |
| ***B05B 1/30*** | (2006.01) |
| *B05B 15/70* | (2018.01) |

(52) U.S. Cl.

CPC ..... *B05B 3/0486* (2013.01); *B05B 1/304* (2013.01); *B05B 3/003* (2013.01); *B05B 3/005* (2013.01); *B05B 3/0477* (2013.01); *B05B 3/0481* (2013.01); *B05B 15/70* (2018.02)

(58) Field of Classification Search

CPC ..... B05B 3/003; B05B 3/0486; B05B 3/0477; B05B 3/0481

See application file for complete search history.

(56) References Cited

U.S. PATENT DOCUMENTS

| | | | |
|---|---|---|---|
| 458,607 | A | 9/1891 | Weiss |
| 1,286,333 | A | 12/1918 | Johnson |
| 1,432,386 | A | 10/1922 | Ctjkwey |
| 1,523,609 | A | 1/1925 | Roach |
| 2,075,589 | A | 3/1937 | Munz |
| 2,125,863 | A | 8/1938 | Arbogast |
| 2,125,978 | A | 8/1938 | Arbogast |

(Continued)

FOREIGN PATENT DOCUMENTS

| | | |
|---|---|---|
| AU | 783999 | 1/2006 |
| CA | 2427450 | 6/2004 |

(Continued)

OTHER PUBLICATIONS

Advisory Action dated Jul. 14, 2011 for U.S. Appl. No. 11/947,571 (3 pgs.).

(Continued)

*Primary Examiner* — Darren W Gorman

(74) *Attorney, Agent, or Firm* — Fitch, Even, Tabin & Flannery LLP

(57) ABSTRACT

An irrigation nozzle with a rotating deflector is provided whose rotational speed may be controlled by a friction brake. The nozzle may also include an arc adjustment valve having two portions that helically engage each other to define an opening that may be adjusted at the top of the sprinkler to a desired arcuate length. The arcuate length may be adjusted by pressing down and rotating a deflector to directly actuate the valve. The nozzle may also include a radius reduction valve that may be adjusted by actuation of an outer wall of the nozzle. Rotation of the outer wall causes a flow control member to move axially to or away from an inlet.

19 Claims, 15 Drawing Sheets

(56) References Cited

U.S. PATENT DOCUMENTS

| | | | |
|---|---|---|---|
| 2,128,552 | A | 8/1938 | Rader |
| 2,130,810 | A | 9/1938 | Munz |
| 2,325,280 | A | 7/1943 | Scherrer |
| 2,348,776 | A | 5/1944 | Bentley |
| 2,634,163 | A | 4/1953 | Double |
| 2,723,879 | A | 11/1955 | Martin |
| 2,785,013 | A | 3/1957 | Stearns |
| 2,875,783 | A | 3/1959 | Schippers |
| 2,914,257 | A | 11/1959 | Wiant |
| 2,935,266 | A | 5/1960 | Coleondro |
| 2,990,123 | A | 6/1961 | Hyde |
| 2,990,128 | A | 6/1961 | Knutsen |
| 3,005,593 | A | 10/1961 | Smith |
| 3,029,030 | A | 4/1962 | Dey, Sr. |
| 3,030,032 | A | 4/1962 | Luhman, Jr. |
| 3,109,591 | A | 11/1963 | Moen |
| 3,239,149 | A | 3/1966 | Lindberg, Jr. |
| 3,380,659 | A | 4/1968 | Seablom |
| 3,386,662 | A | 6/1968 | Kennedy |
| 3,752,403 | A | 8/1973 | Diest |
| 3,854,664 | A | 12/1974 | Hunter |
| 3,955,764 | A | 5/1976 | Phaup |
| 3,979,066 | A | 9/1976 | Fortner |
| 4,026,471 | A | 5/1977 | Hunter |
| 4,067,497 | A | 1/1978 | Cornelius |
| 4,099,675 | A | 7/1978 | Wohler |
| 4,119,275 | A | 10/1978 | Hunter |
| 4,121,769 | A | 10/1978 | Drori |
| 4,131,234 | A | 12/1978 | Pescetto |
| 4,189,099 | A | 2/1980 | Bruninga |
| 4,198,000 | A | 4/1980 | Hunter |
| 4,253,608 | A | 3/1981 | Hunter |
| 4,272,024 | A | 6/1981 | Kah |
| 4,316,579 | A | 2/1982 | Ray |
| 4,353,506 | A | 10/1982 | Hayes |
| 4,353,507 | A | 10/1982 | Kah |
| 4,398,666 | A | 8/1983 | Hunter |
| 4,417,691 | A | 11/1983 | Lockwood |
| 4,456,181 | A | 6/1984 | Burnham |
| 4,471,908 | A | 9/1984 | Hunter |
| 4,479,611 | A | 10/1984 | Galvis |
| 4,501,391 | A | 2/1985 | Hunter |
| 4,566,632 | A | 1/1986 | Sesser |
| 4,568,024 | A | 2/1986 | Hunter |
| 4,579,284 | A | 4/1986 | Arnold |
| 4,579,285 | A | 4/1986 | Hunter |
| 4,609,146 | A | 9/1986 | Walto |
| 4,618,100 | A | 10/1986 | White |
| 4,624,412 | A | 11/1986 | Hunter |
| 4,625,917 | A | 12/1986 | Torney |
| RE32,386 | E | 3/1987 | Hunter |
| 4,660,766 | A | 4/1987 | Nelson |
| 4,669,663 | A | 6/1987 | Meyer |
| 4,676,438 | A | 6/1987 | Sesser |
| 4,681,260 | A | 7/1987 | Cochran |
| 4,681,263 | A | 7/1987 | Cockman |
| 4,682,732 | A | 7/1987 | Walto |
| 4,699,321 | A | 10/1987 | Bivens |
| 4,708,291 | A | 11/1987 | Grundy |
| 4,711,399 | A | 12/1987 | Rosenberg |
| 4,718,605 | A | 1/1988 | Hunter |
| 4,720,045 | A | 1/1988 | Meyer |
| 4,739,394 | A | 4/1988 | Oda |
| 4,739,934 | A | 4/1988 | Gewelber |
| D296,464 | S | 6/1988 | Marmol |
| 4,752,031 | A | 6/1988 | Merrick |
| 4,760,958 | A | 8/1988 | Greenberg |
| 4,763,838 | A | 8/1988 | Holcomb |
| 4,783,004 | A | 11/1988 | Lockwood |
| 4,784,325 | A | 11/1988 | Walker |
| 4,796,809 | A | 1/1989 | Hunter |
| 4,796,811 | A | 1/1989 | Davisson |
| 4,815,662 | A | 3/1989 | Hunter |
| 4,834,289 | A | 5/1989 | Hunter |
| 4,836,449 | A | 6/1989 | Hunter |
| 4,836,450 | A | 6/1989 | Hunter |
| 4,840,312 | A | 6/1989 | Tyler |
| 4,842,201 | A | 6/1989 | Hunter |
| 4,867,378 | A | 9/1989 | Kah |
| 4,898,332 | A | 2/1990 | Hunter |
| 4,901,924 | A | 2/1990 | Kah |
| 4,932,590 | A | 6/1990 | Hunter |
| 4,944,456 | A | 7/1990 | Zakai |
| 4,948,052 | A | 8/1990 | Hunter |
| 4,955,542 | A | 9/1990 | Kah |
| 4,957,240 | A | 9/1990 | Rosenberg |
| 4,961,534 | A | 10/1990 | Tyler |
| 4,967,961 | A | 11/1990 | Hunter |
| 4,971,250 | A | 11/1990 | Hunter |
| 4,971,256 | A | 11/1990 | Malcolm |
| D312,865 | S | 12/1990 | Davisson |
| 4,986,474 | A | 1/1991 | Schisler |
| 5,009,368 | A | 4/1991 | Streck |
| 5,031,840 | A | 7/1991 | Grundy |
| 5,050,800 | A | 9/1991 | Lamar |
| 5,052,621 | A | 10/1991 | Katzer |
| 5,058,806 | A | 10/1991 | Rupar |
| 5,078,321 | A | 1/1992 | Davis |
| 5,083,709 | A | 1/1992 | Iwanowski |
| RE33,823 | E | 2/1992 | Nelson |
| 5,086,977 | A | 2/1992 | Kah |
| 5,090,619 | A | 2/1992 | Barthold |
| 5,098,021 | A | 3/1992 | Kah |
| 5,104,045 | A | 4/1992 | Kah |
| 5,123,597 | A | 6/1992 | Bendall |
| 5,141,024 | A | 8/1992 | Hicks |
| 5,148,990 | A | 9/1992 | Kah |
| 5,148,991 | A | 9/1992 | Kah |
| 5,152,458 | A | 10/1992 | Curtis |
| 5,158,232 | A | 10/1992 | Tyler |
| 5,174,501 | A | 12/1992 | Hadar |
| 5,199,646 | A | 4/1993 | Kah |
| 5,205,491 | A | 4/1993 | Hadar |
| 5,224,653 | A | 7/1993 | Nelson |
| 5,226,599 | A | 7/1993 | Lindermeir |
| 5,226,602 | A | 7/1993 | Cochran |
| 5,234,169 | A | 8/1993 | McKenzie |
| 5,240,182 | A | 8/1993 | Lemme |
| 5,240,184 | A | 8/1993 | Lawson |
| 5,267,689 | A | 12/1993 | Forer |
| 5,288,022 | A | 2/1994 | Sesser |
| 5,297,737 | A | 3/1994 | Davisson |
| 5,299,742 | A | 4/1994 | Han |
| 5,307,993 | A | 5/1994 | Simonetti |
| 5,322,223 | A | 6/1994 | Hadar |
| 5,335,857 | A | 8/1994 | Hagon |
| 5,360,167 | A | 11/1994 | Grundy |
| 5,370,311 | A | 12/1994 | Chen |
| 5,372,307 | A | 12/1994 | Sesser |
| 5,375,768 | A | 12/1994 | Clark |
| 5,377,914 | A | 1/1995 | Christen |
| 5,398,872 | A | 3/1995 | Joubran |
| 5,415,348 | A | 5/1995 | Nelson |
| 5,417,370 | A | 5/1995 | Kah |
| 5,423,486 | A | 6/1995 | Hunter |
| 5,435,490 | A | 7/1995 | Machut |
| 5,439,174 | A | 8/1995 | Sweet |
| RE35,037 | E | 9/1995 | Kah |
| 5,456,411 | A | 10/1995 | Scott |
| 5,503,139 | A | 4/1996 | McMahon |
| 5,526,982 | A | 6/1996 | McKenzie |
| 5,544,814 | A | 8/1996 | Spenser |
| 5,556,036 | A | 9/1996 | Chase |
| 5,588,594 | A | 12/1996 | Kah |
| 5,588,595 | A | 12/1996 | Sweet |
| 5,598,977 | A | 2/1997 | Lemme |
| 5,611,488 | A | 3/1997 | Frolich |
| 5,620,141 | A | 4/1997 | Chiang |
| 5,640,983 | A | 6/1997 | Sherman |
| 5,642,861 | A | 7/1997 | Ogi |
| 5,653,390 | A | 8/1997 | Kah |
| 5,662,545 | A | 9/1997 | Zimmerman |
| 5,669,449 | A | 9/1997 | Polan |
| 5,671,885 | A | 9/1997 | Davisson |

(56) References Cited

U.S. PATENT DOCUMENTS 5,671,886 A 9/1997 Sesser
5,676,315 A 10/1997 Han
D388,502 S 12/1997 Kah
5,695,123 A 12/1997 Le
5,699,962 A 12/1997 Scott
5,711,486 A 1/1998 Clark
5,718,381 A 2/1998 Katzer
5,720,435 A 2/1998 Hunter
5,722,593 A 3/1998 McKenzie
5,758,827 A 6/1998 Van Le
5,762,270 A 6/1998 Kearby
5,765,757 A 6/1998 Bendall
5,765,760 A 6/1998 Kuo
5,769,322 A 6/1998 Smith
5,785,248 A 7/1998 Staylor
5,820,029 A 10/1998 Marans
5,823,439 A 10/1998 Hunter
5,823,440 A 10/1998 Clark
5,826,797 A 10/1998 Kah
5,845,849 A 12/1998 Mitzlaff
5,875,969 A 3/1999 Grundy
5,918,812 A 7/1999 Beutler
5,927,607 A 7/1999 Scott
5,971,297 A 10/1999 Sesser
5,988,523 A 11/1999 Scott
5,992,760 A 11/1999 Kearby
6,007,001 A 12/1999 Hilton
6,019,295 A 2/2000 McKenzie
6,029,907 A 2/2000 McKenzie
6,042,021 A 3/2000 Clark
6,050,502 A 4/2000 Clark
6,059,044 A 5/2000 Fischer
6,076,744 A 6/2000 O'Brien
6,076,747 A 6/2000 Ming-Yuan
6,085,995 A 7/2000 Kah
6,092,739 A 7/2000 Clearman
6,102,308 A 8/2000 Steingass
6,109,545 A 8/2000 Kah
6,135,364 A 10/2000 Nickish
6,138,924 A 10/2000 Hunter
6,142,386 A 11/2000 Spenser
6,145,758 A 11/2000 Ogi
6,155,493 A 12/2000 Kearby
6,158,675 A 12/2000 Ogi
6,182,909 B1 2/2001 Kah
6,186,413 B1 2/2001 Lawson
6,223,999 B1 5/2001 Lemelshtrich
6,227,455 B1 5/2001 Scott
6,230,988 B1 5/2001 Chao
6,230,989 B1 5/2001 Haverstraw
6,237,862 B1 5/2001 Kah
6,241,158 B1 6/2001 Clark
6,244,521 B1 6/2001 Sesser
6,254,013 B1 7/2001 Clearman
6,264,117 B1 7/2001 Roman
6,276,460 B1 8/2001 Pahila
6,286,767 B1 9/2001 Hui-Chen
6,332,581 B1 12/2001 Chin
6,336,597 B1 1/2002 Kah
6,341,733 B1 1/2002 Sweet
6,345,541 B1 2/2002 Hendey
6,367,708 B1 4/2002 Olson
D458,342 S 6/2002 Johnson
6,443,372 B1 9/2002 Hsu
6,454,186 B2 9/2002 Haverstraw
6,457,656 B1 10/2002 Scott
6,464,151 B1 10/2002 Cordua
6,478,237 B2 11/2002 Kearby
6,481,644 B1 11/2002 Olsen
6,488,218 B1 12/2002 Townsend
6,491,235 B1 12/2002 Scott
6,494,384 B1 12/2002 Meyer
6,499,672 B1 12/2002 Sesser
6,516,893 B2 2/2003 Pahila
6,530,531 B2 3/2003 Butler
6,601,781 B2 8/2003 Kah
6,607,147 B2 8/2003 Schneider
6,622,940 B2 9/2003 Huang
6,637,672 B2 10/2003 Cordua
6,651,904 B2 11/2003 Roman
6,651,905 B2 * 11/2003 Sesser ..... B05B 1/262 239/205
6,688,539 B2 2/2004 Vander Griend
6,695,223 B2 2/2004 Beutler
6,715,699 B1 4/2004 Greenberg
6,719,218 B2 4/2004 Cool
6,732,950 B2 5/2004 Ingham, Jr.
6,732,952 B2 5/2004 Kah
6,736,332 B2 * 5/2004 Sesser ..... B05B 1/262 239/204
6,736,336 B2 5/2004 Wong
6,737,332 B1 5/2004 Fuselier
6,769,633 B1 8/2004 Huang
6,793,152 B1 9/2004 Drechsel
6,814,304 B2 11/2004 Onofrio
6,814,305 B2 11/2004 Townsend
6,817,543 B2 11/2004 Clark
6,820,825 B1 11/2004 Wang
6,827,291 B2 12/2004 Townsend
6,834,816 B2 12/2004 Kah
6,840,460 B2 1/2005 Clark
6,848,632 B2 2/2005 Clark
6,854,664 B2 2/2005 Smith
6,869,026 B2 3/2005 McKenzie
6,871,795 B2 3/2005 Anuskiewicz
6,880,768 B2 4/2005 Lau
6,883,727 B2 4/2005 De Los Santos
6,899,287 B2 5/2005 Pinch
6,921,030 B2 7/2005 Renquist
6,942,164 B2 * 9/2005 Walker ..... B05B 3/0422 239/201
6,945,471 B2 9/2005 McKenzie
6,957,782 B2 10/2005 Clark
6,976,543 B1 12/2005 Fischer
6,997,393 B1 2/2006 Angold
7,017,831 B2 3/2006 Santiago
7,017,837 B2 3/2006 Taketomi
7,028,920 B2 4/2006 Hekman
7,028,927 B2 4/2006 Mermet
7,032,836 B2 * 4/2006 Sesser ..... B05B 1/262 239/204
7,032,844 B2 4/2006 Cordua
7,040,553 B2 5/2006 Clark
7,044,403 B2 5/2006 Kah
7,070,122 B2 7/2006 Burcham
7,090,146 B1 8/2006 Ericksen
7,100,842 B2 9/2006 Meyer
7,104,472 B2 9/2006 Renquist
7,111,795 B2 9/2006 Thong
7,143,957 B2 12/2006 Nelson
7,143,962 B2 12/2006 Kah
7,152,814 B1 12/2006 Schapper
7,156,322 B1 1/2007 Heitzman
7,159,795 B2 1/2007 Sesser
7,168,634 B2 1/2007 Onofrio
7,232,078 B2 6/2007 Kah, Jr.
7,232,081 B2 6/2007 Kah
7,234,651 B2 6/2007 Mousavi
7,240,860 B2 7/2007 Griend
7,287,711 B2 10/2007 Crooks
7,293,721 B2 11/2007 Roberts
7,299,999 B2 11/2007 Walker
7,303,147 B1 12/2007 Danner
7,303,153 B2 12/2007 Han
7,322,533 B2 1/2008 Grizzle
7,337,988 B2 3/2008 McCormick
7,383,721 B2 6/2008 Parsons
7,389,942 B2 6/2008 Kenyon
RE40,440 E 7/2008 Sesser
7,392,956 B2 7/2008 McKenzie
7,395,977 B2 7/2008 Pinch
7,429,005 B2 9/2008 Schapper
7,458,527 B2 12/2008 Lutzki
7,478,526 B2 1/2009 McAfee

(56) References Cited

U.S. PATENT DOCUMENTS 7,533,833 B2 5/2009 Wang
7,581,687 B2 9/2009 Feith
7,584,906 B2 9/2009 Lev
7,597,273 B2 10/2009 McAfee
7,607,588 B2 10/2009 Nobili
7,611,077 B2 11/2009 Sesser
7,621,464 B2 11/2009 Smith
7,621,467 B1 11/2009 Garcia
7,624,935 B2 12/2009 Nelson
7,654,474 B2 2/2010 Cordua
7,686,235 B2 3/2010 Roberts
7,686,236 B2 3/2010 Alexander
7,703,706 B2 4/2010 Walker
D615,152 S 5/2010 Kah
7,717,361 B2 5/2010 Nelson
7,766,259 B2 8/2010 Feith
7,789,323 B2 9/2010 Nelson
7,819,339 B2 10/2010 Dieziger
D628,272 S 11/2010 Kah
7,828,229 B2 11/2010 Kah
7,850,094 B2 12/2010 Richmond
7,861,948 B1 1/2011 Crooks
D636,459 S 4/2011 Kah
7,926,746 B2 4/2011 Melton
7,971,804 B2 7/2011 Roberts
RE42,596 E 8/2011 Sesser
8,006,919 B2 8/2011 Renquist
8,011,602 B2 9/2011 Coppersmith
8,047,456 B2 11/2011 Kah
8,056,829 B2 11/2011 Gregory
8,074,897 B2 * 12/2011 Hunnicutt ..... B05B 3/003 239/204
8,083,158 B2 12/2011 Katzman
8,205,811 B2 6/2012 Cordua
8,272,583 B2 * 9/2012 Hunnicutt ..... B05B 1/304 239/582.1
8,282,022 B2 10/2012 Porter
8,297,533 B2 10/2012 Dunn
8,408,482 B2 4/2013 Gregory
8,567,699 B2 10/2013 Sesser
8,651,400 B2 2/2014 Walker
8,672,242 B2 3/2014 Hunnicutt
8,695,900 B2 * 4/2014 Hunnicutt ..... B05B 1/304 239/224
8,783,582 B2 7/2014 Robertson
8,789,768 B2 7/2014 Hunnicutt
8,925,837 B2 * 1/2015 Walker ..... B05B 1/304 239/224
8,991,724 B2 3/2015 Sesser
8,991,726 B2 3/2015 Kah
8,998,109 B2 4/2015 Katzman
9,056,214 B2 6/2015 Barmoav
9,079,202 B2 7/2015 Walker
9,174,227 B2 11/2015 Robertson
9,179,612 B2 11/2015 Nelson
9,248,459 B2 2/2016 Kah, Jr.
9,295,998 B2 3/2016 Shadbolt
9,314,952 B2 4/2016 Walker
9,327,297 B2 5/2016 Walker
9,387,496 B2 7/2016 Kah, III
9,427,751 B2 8/2016 Kim
9,492,832 B2 11/2016 Kim
9,504,209 B2 11/2016 Kim
9,534,619 B2 1/2017 Sesser
9,555,422 B2 1/2017 Zhao
9,587,687 B2 3/2017 Sesser
9,669,420 B2 6/2017 Heren
9,757,743 B2 9/2017 Kah, Jr.
9,808,813 B1 11/2017 Porter
9,981,276 B2 5/2018 Kah, Jr.
2001/0023901 A1 9/2001 Haverstraw
2002/0070289 A1 6/2002 Hsu
2002/0130202 A1 9/2002 Kah
2002/0139868 A1 10/2002 Sesser
2002/0153434 A1 10/2002 Cordua
2003/0006304 A1 1/2003 Cool
2003/0015606 A1 1/2003 Cordua
2003/0042327 A1 3/2003 Beutler
2003/0071140 A1 4/2003 Roman
2003/0075620 A1 4/2003 Kah
2004/0108391 A1 6/2004 Onofrio
2005/0006501 A1 1/2005 Englefield
2005/0161534 A1 7/2005 Kah
2005/0194464 A1 9/2005 Bruninga
2005/0194479 A1 9/2005 Curtis
2005/0199842 A1 9/2005 Parsons
2006/0038046 A1 2/2006 Curtis
2006/0086832 A1 4/2006 Roberts
2006/0086833 A1 4/2006 Roberts
2006/0108445 A1 5/2006 Pinch
2006/0144968 A1 7/2006 Lev
2006/0219815 A1 10/2006 Hekman
2006/0237198 A1 10/2006 Crampton
2006/0273202 A1 12/2006 Su
2006/0281375 A1 12/2006 Jordan
2007/0012800 A1 1/2007 McAfee
2007/0034711 A1 2/2007 Kah
2007/0034712 A1 2/2007 Kah
2007/0119975 A1 5/2007 Hunnicutt
2007/0181711 A1 8/2007 Sesser
2007/0235565 A1 10/2007 Kah
2007/0246567 A1 10/2007 Roberts
2008/0087743 A1 4/2008 Govrin
2008/0169363 A1 7/2008 Walker
2008/0217427 A1 9/2008 Wang
2008/0257982 A1 10/2008 Kah
2008/0276391 A1 11/2008 Jung
2008/0277499 A1 11/2008 McAfee
2009/0001193 A1 1/2009 Parsons
2009/0008484 A1 1/2009 Feith
2009/0014559 A1 1/2009 Marino
2009/0072048 A1 3/2009 Renquist
2009/0078788 A1 3/2009 Holmes
2009/0108099 A1 4/2009 Porter
2009/0140076 A1 * 6/2009 Cordua ..... B05B 1/3026 239/457
2009/0173803 A1 7/2009 Kah
2009/0173904 A1 7/2009 Roberts
2009/0179165 A1 7/2009 Parsons
2009/0188988 A1 7/2009 Walker
2009/0224070 A1 9/2009 Clark
2010/0090024 A1 4/2010 Hunnicutt
2010/0108787 A1 5/2010 Walker
2010/0176217 A1 7/2010 Richmond
2010/0257670 A1 10/2010 Hodel
2010/0276512 A1 11/2010 Nies
2010/0301135 A1 12/2010 Hunnicutt
2010/0301142 A1 12/2010 Hunnicutt
2011/0024522 A1 2/2011 Anuskiewicz
2011/0089250 A1 4/2011 Zhao
2011/0121097 A1 5/2011 Walker
2011/0147484 A1 6/2011 Jahan
2011/0248093 A1 10/2011 Kim
2011/0248094 A1 10/2011 Robertson
2011/0248097 A1 10/2011 Kim
2011/0309161 A1 12/2011 Renquist
2011/0309274 A1 12/2011 Parsons
2012/0012670 A1 1/2012 Kah
2012/0061489 A1 3/2012 Hunnicutt
2012/0153051 A1 6/2012 Kah
2012/0292403 A1 11/2012 Hunnicutt
2013/0334332 A1 12/2013 Robertson
2013/0334340 A1 * 12/2013 Walker ..... B05B 3/0486 239/222.15
2014/0027526 A1 * 1/2014 Shadbolt ..... B05B 1/26 239/1
2014/0027527 A1 * 1/2014 Walker ..... B05B 1/267 239/1
2014/0224900 A1 8/2014 Kim
2014/0339334 A1 * 11/2014 Kah, Jr. ..... B05B 3/021 239/222.13
2015/0224520 A1 8/2015 Kim
2016/0107177 A1 4/2016 Kah, Jr.
2017/0056899 A1 3/2017 Kim

(56) References Cited

U.S. PATENT DOCUMENTS

| | | | |
|---|---|---|---|
| 2017/0203311 | A1 | 7/2017 | Kim |
| 2017/0348709 | A1 | 12/2017 | Kah, Jr. |
| 2018/0141060 | A1 | 5/2018 | Walker |

FOREIGN PATENT DOCUMENTS

| | | | |
|---|---|---|---|
| CN | 2794646 | | 7/2006 |
| CN | 2805823 | | 8/2006 |
| DE | 1283591 | B | 11/1968 |
| DE | 3335805 | A1 | 2/1985 |
| DE | 19925279 | | 12/1999 |
| EP | 0274082 | | 7/1988 |
| EP | 0463742 | | 1/1992 |
| EP | 0489679 | | 6/1992 |
| EP | 0518579 | | 12/1992 |
| EP | 0572747 | | 12/1993 |
| EP | 0646417 | | 4/1995 |
| EP | 0724913 | A2 | 8/1996 |
| EP | 0761312 | A1 | 12/1997 |
| EP | 1016463 | | 7/2000 |
| EP | 1043077 | | 10/2000 |
| EP | 1043075 | A1 | 11/2000 |
| EP | 1173286 | | 1/2002 |
| EP | 1250958 | | 10/2002 |
| EP | 1270082 | | 1/2003 |
| EP | 1289673 | | 3/2003 |
| EP | 1426112 | | 6/2004 |
| EP | 1440735 | | 7/2004 |
| EP | 1452234 | | 9/2004 |
| EP | 1502660 | | 2/2005 |
| EP | 1508378 | | 2/2005 |
| EP | 1818104 | | 8/2007 |
| EP | 1944090 | | 7/2008 |
| EP | 2251090 | A2 | 11/2010 |
| EP | 2255884 | A1 | 12/2010 |
| EP | 3311926 | | 4/2018 |
| FR | 2730901 | | 9/1997 |
| GB | 908314 | | 10/1962 |
| GB | 1234723 | | 6/1971 |
| GB | 2330783 | | 5/1999 |
| IL | 35182 | | 0/4197 |
| WO | 1995020988 | | 8/1995 |
| WO | 1997027951 | | 8/1997 |
| WO | 9735668 | | 10/1997 |
| WO | 2000007428 | | 12/2000 |
| WO | 200131996 | | 5/2001 |
| WO | 2001031996 | | 5/2001 |
| WO | 200162395 | | 8/2001 |
| WO | 2001062395 | | 8/2001 |
| WO | 2002078857 | | 10/2002 |
| WO | 2002098570 | | 12/2002 |
| WO | 2003086643 | | 10/2003 |
| WO | 2004052721 | | 6/2004 |
| WO | 2005099905 | | 10/2005 |
| WO | 2005115554 | | 12/2005 |
| WO | 2005123263 | | 12/2005 |
| WO | 2006108298 | | 10/2006 |
| WO | 2007131270 | | 11/2007 |
| WO | 2008130393 | | 10/2008 |
| WO | 2009036382 | | 3/2009 |
| WO | 2010036241 | | 4/2010 |
| WO | 2010126769 | | 11/2010 |
| WO | 2011075690 | | 6/2011 |
| WO | 2014018892 | | 1/2014 |
| WO | 2014124314 | | 8/2014 |

OTHER PUBLICATIONS

Applicant-Initiated Interview Summary and Final Office Action dated Mar. 5, 2014 for U.S. Appl. No. 12/972,271 (12 pgs.).
EPO Search Report and Opinion, dated Aug. 5, 2010 for EPO Application No. 10164085.2 (5 pgs.).
European Patent Office, Extended European Search Report and Opinion for European Patent Application No. 17197674.9 dated Mar. 26, 2018, 8 pages.
European Patent Office, Partial European Search Report and Opinion for European Patent Application No. 17201824.4 dated Apr. 20, 2018 (16 pages).
Final Office Action dated Apr. 5, 2011 for U.S. Appl. No. 11/947,571 (11 pgs.).
Final Office Action dated Dec. 5, 2013 for U.S. Appl. No. 12/972,271 (9 pgs.).
Interview Summary dated Sep. 26, 2011 for U.S. Appl. No. 12/475,242 (3 pgs.).
Non-Final Office Action dated Dec. 16, 2014 for U.S. Appl. No. 13/560,423 (18 pgs.).
Non-Final Office Action dated Jan. 10, 2014 for U.S. Appl. No. 13/069,334 (6 pgs.).
Non-Final Office Action dated Jan. 22, 2015 for U.S. Appl. No. 13/828,582 (21 pgs.).
Non-Final Office Action dated Nov. 5, 2014 for U.S. Appl. No. 13/495,402.
Non-Final Office Action dated Apr. 10, 2013 for U.S. Appl. No. 13/562,825 (22 pgs.).
Non-Final Office Action dated Aug. 24, 2010 for U.S. Appl. No. 11/947,571 (11 pgs.).
Non-Final Office Action dated Dec. 16, 2014 for U.S. Appl. No. 13/560,423.
Non-Final Office Action dated Dec. 4, 2012 for U.S. Appl. No. 12/686,895 (29 pgs.).
Non-Final Office Action dated Jan. 5, 2011 for U.S. Appl. No. 12/248,644 (20 pgs.).
Non-Final Office Action dated Jul. 20, 2011 for U.S. Appl. No. 12/475,242 (17 pgs.).
Non-Final Office Action dated Jun. 5, 2013 for U.S. Appl. No. 12/972,271 (8 pgs.).
Non-Final Office Action dated Jun. 7, 2012 for U.S. Appl. No. 13/300,946 (9 pgs.).
Non-Final Office Action dated Mar. 29, 2011 for U.S. Appl. No. 12/475,242 (7 pgs.).
Non-Final Office Action dated May 24, 2013 U.S. Appl. No. 12/720,261 (67 pgs.).
Non-Final Office Action dated Oct. 12, 2012 for U.S. Appl. No. 13/300,946 (7 pgs.).
Non-Final Office Action dated Oct. 15, 2012 for U.S. Appl. No. 13/562,825 (10 pgs.).
Non-Final Office Action dated Oct. 15, 2012 for U.S. Appl. No. 13/562,825 (20 pgs.).
Non-Final Office Action dated Sep. 3, 2013 for U.S. Appl. No. 13/300,946. (5 pgs.).
Non-Final Office Action dated Sep. 30, 2010 for U.S. Appl. No. 12/248,644 (7 pgs.).
Response dated Apr. 10, 2015 to Office Action dated Dec. 16, 2014 for U.S. Appl. No. 13/560,423 (21 pgs).
Response dated Apr. 22, 2015 to Non-Final Office Action dated Jan. 22, 2015 for U.S. Appl. No. 13/828,582 (19 pgs).
Response dated Apr. 29, 2011 to Office Action dated Mar. 29, 2011 for U.S. Appl. No. 12/475,242 (13 pgs.).
Response dated Feb. 10, 2014 to Office Action dated Jan. 10, 2014 for U.S. Appl. No. 13/069,334 (3 pgs.).
Response dated Feb. 4, 2015 to Office Action dated Nov. 5, 2014 for U.S. Appl. No. 13/495,402 (16 pgs.).
Response dated Jul. 25, 2012 to Non-Final Office Action dated Apr. 25, 2012 for U.S. Appl. No. 12/757,912 (27 pgs.).
Response dated Jun. 25, 2012 to Office Action dated Jun. 7, 2012 for U.S. Appl. No. 13/300,946 (12 pgs.).
Response dated Mar. 25, 2013 to Final Rejection dated Oct. 23, 2012 for U.S. Appl. No. 12/757,912 (20 pgs.).
Response dated Nov. 24, 2010 to Office Action dated Aug. 24, 2010 for U.S. Appl. No. 11/947,571 (19 pgs.).
Response dated Oct. 18, 2011 to Office Action dated Jul. 20, 2011 for U.S. Appl. No. 11/947,571 (11 pgs.).
Response dated Oct. 18, 2011 to Office Action dated Jul. 20, 2011 for U.S. Appl. No. 12/475,242 (17 pgs.).

(56) References Cited

OTHER PUBLICATIONS

Response dated Sep. 16, 2013 to Office Action dated Jun. 5, 2013 for U.S. Appl. No. 12/972,271 (15 pgs.).
USPTO Applicant-Initiated Interview Summary dated Apr. 23, 2013 for U.S. Appl. No. 12/757,912 (3 pgs.).
USPTO Final Rejection dated Oct. 23, 2012 for U.S. Appl. No. 12/757,912.
USPTO Non-Final Office Action dated Apr. 25, 2012 for U.S. Appl. No. 12/757,912 (17 pgs.).
U.S. Appl. No. 13/828,582; Non-Final Office Action dated Jan. 22, 2015.
U.S. Appl. No. 13/495,402; Notice of Allowance dated Mar. 6, 2015.
Written Opinion of the International Searching Authority and International Search Report dated Apr. 19, 2011 for Application No. PCT/US10/61132 (12 pgs.).
EPO; App. No. 17201824.4; European Extended Search Report dated Jul. 7, 2018; pp. 1-14.

* cited by examiner

ROTARY NOZZLE

FIELD

This invention relates to irrigation sprinklers and, more particularly, to an irrigation nozzle with a rotating deflector.

BACKGROUND

Nozzles are commonly used for the irrigation of landscape and vegetation. In a typical irrigation system, various types of nozzles are used to distribute water over a desired area, including rotating stream type and fixed spray pattern type nozzles. One type of irrigation nozzle is the rotating deflector or so-called micro-stream type having a rotatable vaned deflector for producing a plurality of relatively small water streams swept over a surrounding terrain area to irrigate adjacent vegetation.

Rotating stream nozzles of the type having a rotatable vaned deflector for producing a plurality of relatively small outwardly projected water streams are known in the art. In such nozzles, one or more jets of water are generally directed upwardly against a rotatable deflector having a vaned lower surface defining an array of relatively small flow channels extending upwardly and turning radially outwardly with a spiral component of direction. The water jet or jets impinge upon this underside surface of the deflector to fill these curved channels and to rotatably drive the deflector. At the same time, the water is guided by the curved channels for projection outwardly from the nozzle in the form of a plurality of relatively small water streams to irrigate a surrounding area. As the deflector is rotatably driven by the impinging water, the water streams are swept over the surrounding terrain area, with the range of throw depending on the radius reduction of water through the nozzle, among other things.

In rotating stream nozzles and in other nozzles, it is desirable to control the arcuate area through which the nozzle distributes water. In this regard, it is desirable to use a nozzle that distributes water through a variable pattern, such as a full circle, half-circle, or some other arc portion of a circle, at the discretion of the user. Traditional variable arc nozzles suffer from limitations with respect to setting the water distribution arc. Some have used interchangeable pattern inserts to select from a limited number of water distribution arcs, such as quarter-circle or half-circle. Others have used punch-outs to select a fixed water distribution arc, but once a distribution arc was set by removing some of the punch-outs, the arc could not later be reduced. Many conventional nozzles have a fixed, dedicated construction that permits only a discrete number of arc patterns and prevents them from being adjusted to any arc pattern desired by the user.

Other conventional nozzle types allow a variable arc of coverage but only for a very limited arcuate range. Because of the limited adjustability of the water distribution arc, use of such conventional nozzles may result in overwatering or underwatering of surrounding terrain. This is especially true where multiple nozzles are used in a predetermined pattern to provide irrigation coverage over extended terrain. In such instances, given the limited flexibility in the types of water distribution arcs available, the use of multiple conventional nozzles often results in an overlap in the water distribution arcs or in insufficient coverage. Thus, certain portions of the terrain are overwatered, while other portions are not watered at all. Accordingly, there is a need for a variable arc nozzle that allows a user to set the water distribution arc along a substantial continuum of arcuate coverage, rather than several models that provide a limited arcuate range of coverage.

DESCRIPTION OF THE PREFERRED EMBODIMENT

Figure 1:
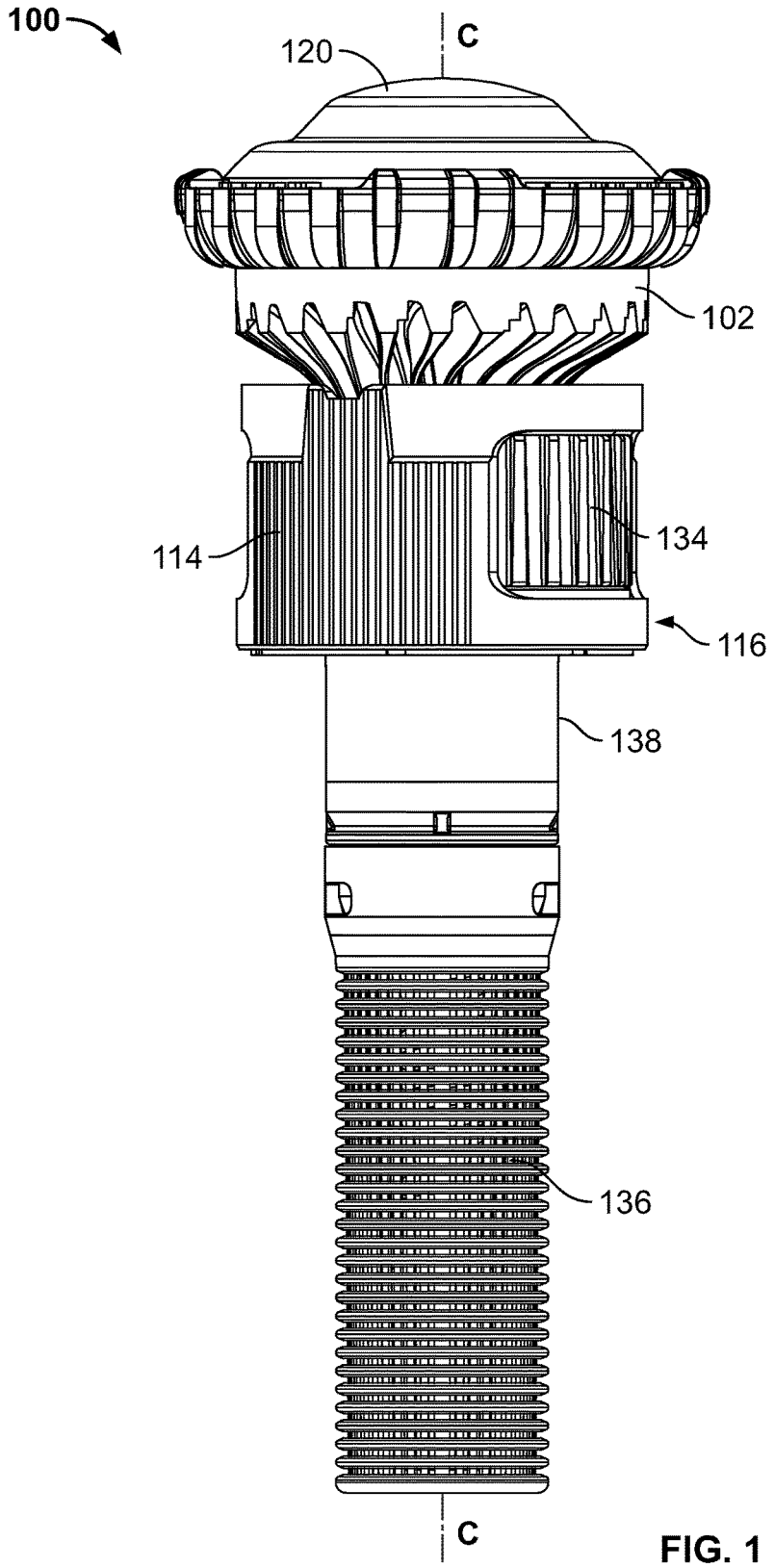
FIG. 1 is an elevation view of a preferred embodiment of a nozzle embodying features of the present invention.
Figure 2:
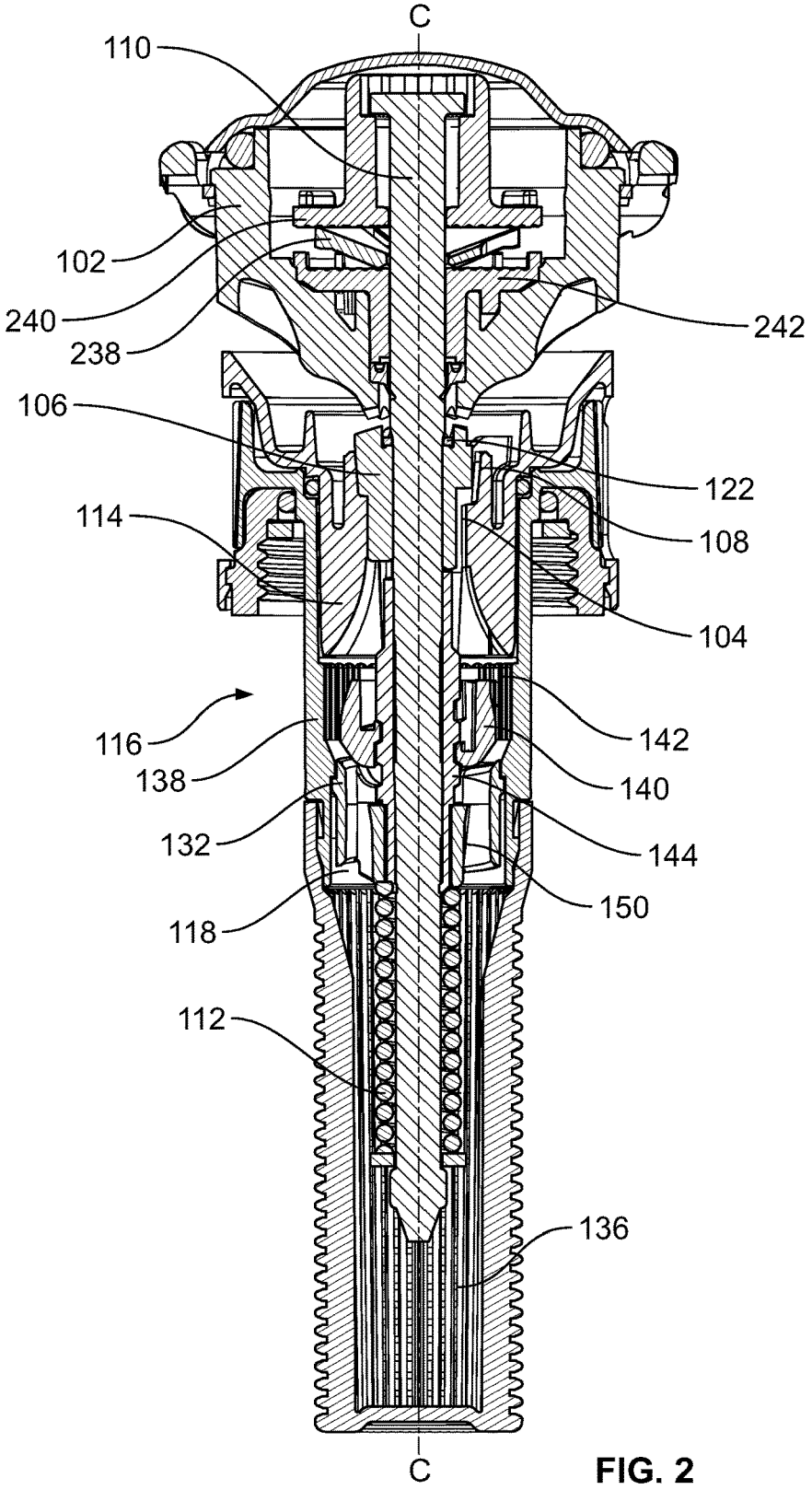
FIG. 2 is a cross-sectional view of the nozzle of FIG. 1.

FIGS. 1 and 2 show a preferred embodiment of the nozzle 100. The nozzle 100 possesses an arc adjustability capability that allows a user to generally set the arc of water distribution to virtually any desired angle. The arc adjustment feature does not require a hand tool to access a slot at the top of the nozzle 100 to rotate a shaft. Instead, the user may depress part or all of the deflector 102 and rotate the deflector 102 to directly set an arc adjustment valve 104. The nozzle 100 also preferably includes a flow rate adjustment feature (or radius reduction feature), which is shown in FIG. 2, to regulate flow rate and throw radius. The radius reduction feature is accessible by rotating an outer wall portion of the nozzle 100, as described further below.

The arc adjustment and radius reduction features of the nozzle 100 are similar to those described in U.S. Pat. No. 8,925,837 and U.S. Pat. No. 9,079,202, which are assigned to the assignee of the present application and which patents are incorporated herein by reference in their entirety. Further, some of the structural components of the nozzle 100 are preferably similar to those described in U.S. Pat. No. 8,925,837 and U.S. Pat. No. 9,079,202, and, as stated, the patents are incorporated herein by reference in their entirety. Differences in the arc adjustment feature, radius reduction feature, and structural components are addressed below and with reference to the figures.

As described in more detail below, the nozzle 100 allows a user to depress and rotate a deflector 102 to directly actuate the arc adjustment valve 104, i.e., to open and close the valve. The user depresses the deflector 102 to directly engage and rotate one of the two nozzle body portions that forms the valve 104 (valve sleeve 106). The valve 104 preferably operates through the use of two helical engagement surfaces that cam against one another to define an arcuate opening 108. Although the nozzle 100 preferably includes a shaft 110, the user does not need to use a hand tool to effect rotation of the shaft 110 to open and close the arc adjustment valve 104. The shaft 110 is not rotated to cause opening and closing of the valve 104. Indeed, the shaft 110 is preferably fixed against rotation, such as through use of splined engagement surfaces.

The nozzle 100 also preferably uses a spring 112 mounted to the shaft 110 to energize and tighten the seal of the closed portion of the arc adjustment valve 104. More specifically, the spring 112 operates on the shaft 110 to bias the first of the two nozzle body portions that forms the valve 104 (valve sleeve 106) downwardly against the second portion (nozzle cover 114). In one preferred form, the shaft 110 translates up and down a total distance corresponding to one helical pitch. The vertical position of the shaft 110 depends on the orientation of the two helical engagement surfaces with respect to one another. By using a spring 112 to maintain a forced engagement between valve sleeve 106 and nozzle cover 114, the nozzle 100 provides a tight seal of the closed portion of the arc adjustment valve 104, concentricity of the valve 104, and a uniform jet of water directed through the valve 104. In addition, mounting the spring 112 at one end of the shaft 110 results in a lower cost of assembly.

Figure 7:
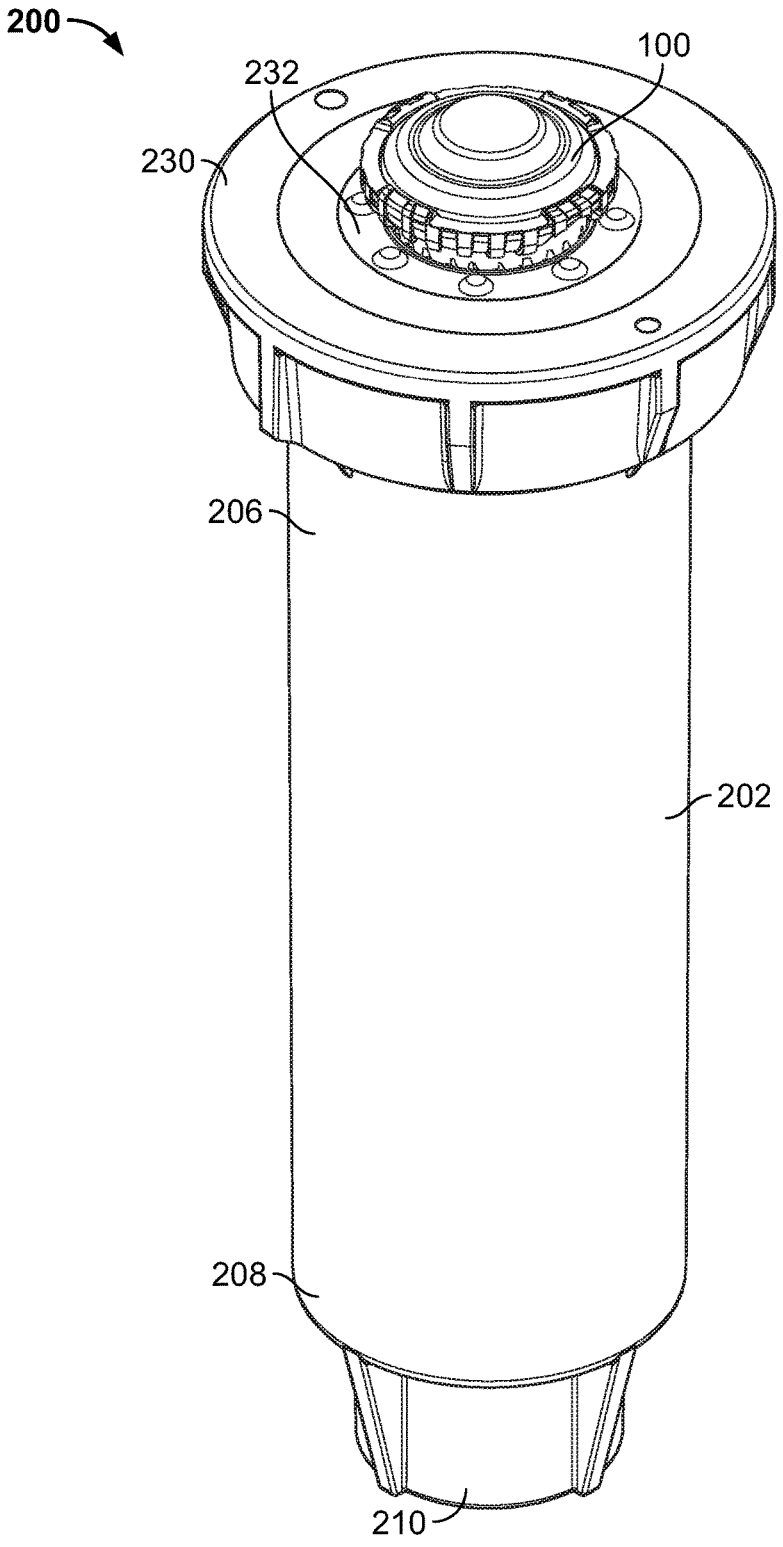
FIG. 7 is a perspective view of a sprinkler assembly including the nozzle of FIG. 1.
Figure 8:
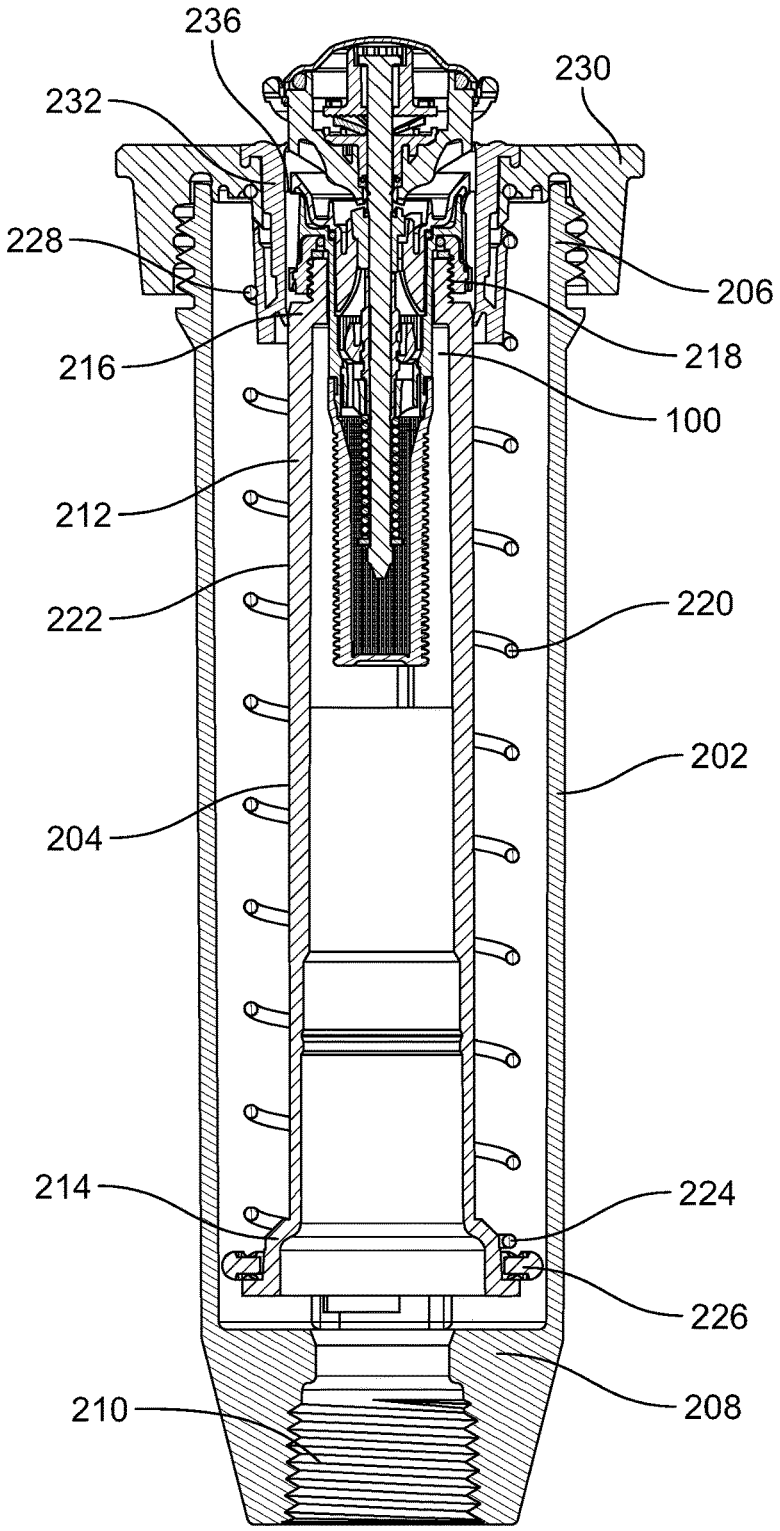
FIG. 8 is a cross-sectional view of the sprinkler assembly of FIG. 7.

As can be seen in FIGS. 1 and 2, the nozzle 100 generally comprises a compact unit, preferably made primarily of lightweight molded plastic, which is adapted for convenient thread-on mounting onto the upper end of a stationary or pop-up riser (FIGS. 7 and 8). In operation, water under pressure is delivered through the riser to a nozzle body 116. The water preferably passes through an inlet 118 controlled by an adjustable flow rate feature that regulates the amount of fluid flow through the nozzle body 116. The water is then directed through an arcuate opening 108 that determines the arcuate span of water distributed from the nozzle 100. Water is directed generally upwardly through the arcuate opening 108 to produce one or more upwardly directed water jets that impinge the underside surface of a deflector 102 for rotatably driving the deflector 102.

Figure 4:
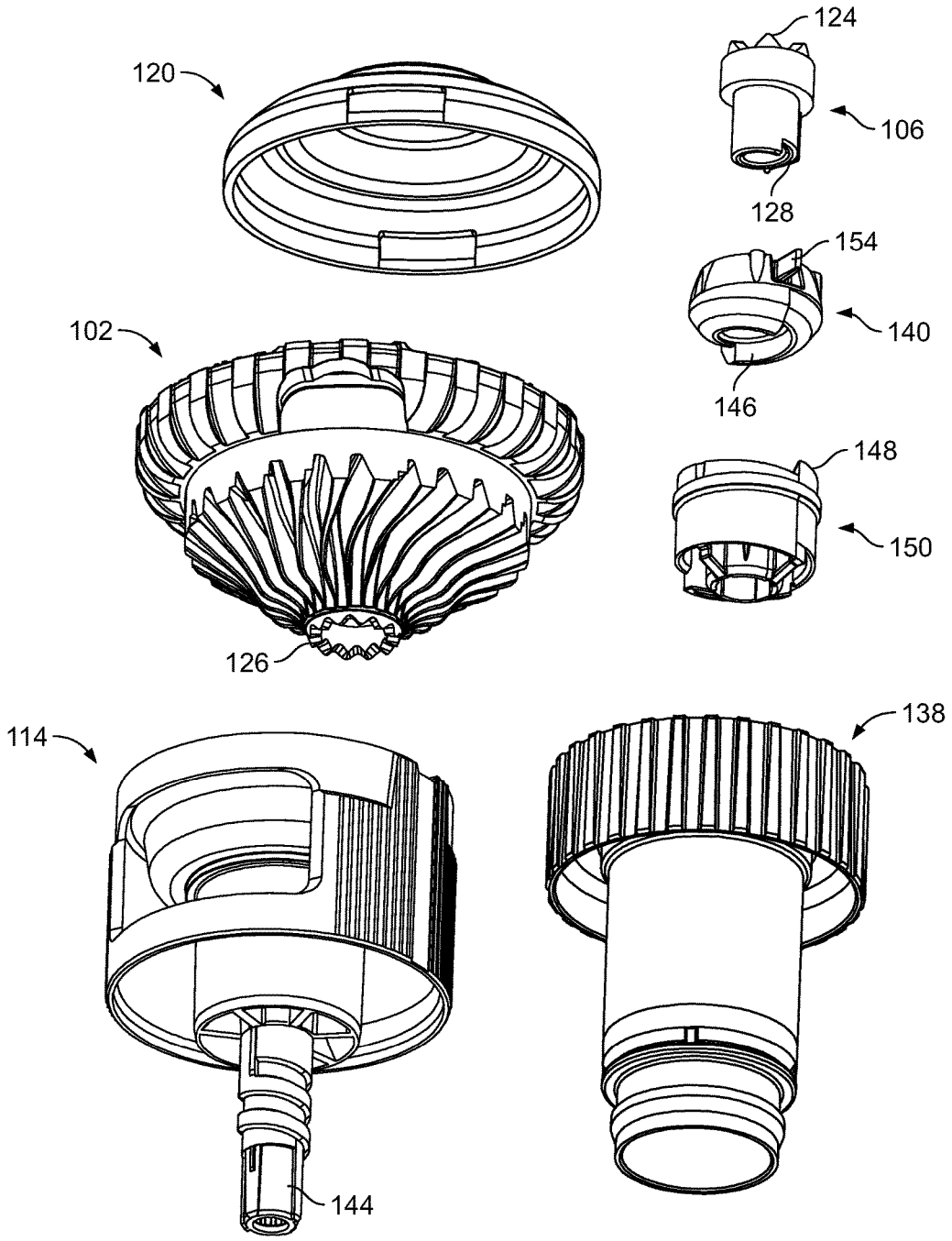
FIG. 4 is a bottom perspective view of the cap, deflector, nozzle cover, valve sleeve, throttle nut, valve seat, and nozzle collar of the nozzle of FIG. 1.

The rotatable deflector 102 has an underside surface that is contoured to deliver a plurality of fluid streams generally radially outwardly therefrom through an arcuate span. As shown in FIG. 4, the underside surface of the deflector 102 preferably includes an array of spiral vanes. The spiral vanes subdivide the water jet or jets into the plurality of relatively small water streams which are distributed radially outwardly therefrom to surrounding terrain as the deflector 102 rotates. The vanes define a plurality of intervening flow channels extending upwardly and spiraling along the underside surface to extend generally radially outwardly with selected inclination angles. A cap 120 is mounted on the deflector 102 to limit the ingress of debris and particulate material into the sensitive components in the interior of the deflector 102, which might otherwise interfere with operation of the nozzle 100. During operation of the nozzle 100, the upwardly directed water jet or jets impinge upon the lower or upstream segments of these vanes, which subdivide the water flow into the plurality of relatively small flow streams for passage through the flow channels and radially outward projection from the nozzle 100. The vanes are curved in a manner and direction to drive rotation of the deflector 102. A deflector like the type shown in U.S. Pat. No. 6,814,304, which is assigned to the assignee of the present application and is incorporated herein by reference in its entirety, is preferably used. Other types of deflectors, however, may also be used.

Figure 3:
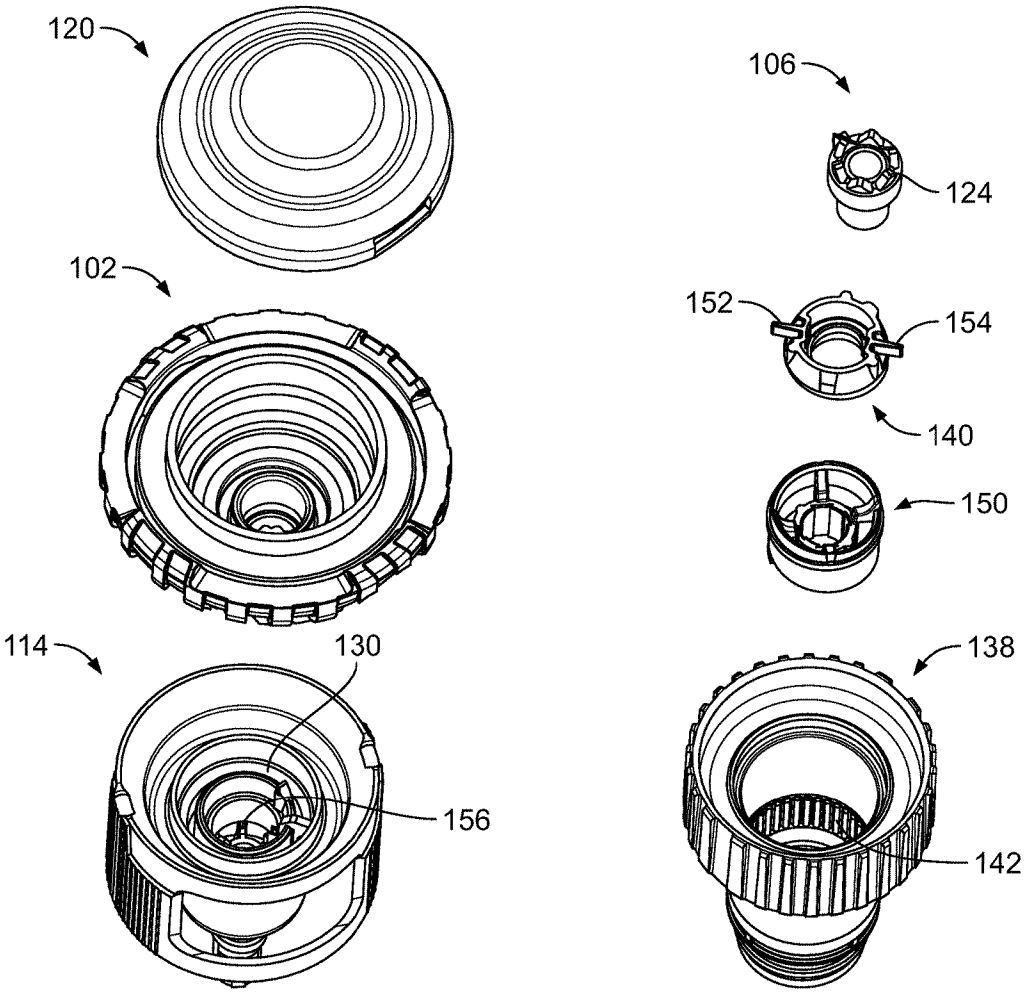
FIG. 3 is a top perspective view of the cap, deflector, nozzle cover, valve sleeve, throttle nut, valve seat, and nozzle collar of the nozzle of FIG. 1.

The variable arc capability of nozzle 100 results from the interaction of two portions of the nozzle body 116 (nozzle cover 114 and valve sleeve 106). More specifically, as can be seen in FIGS. 3 and 4, the nozzle cover 114 and the valve sleeve 106 have corresponding helical engagement surfaces. The valve sleeve 106 may be rotatably adjusted with respect to the nozzle cover 114 to close the arc adjustment valve 104, i.e., to adjust the length of arcuate opening 108, and this rotatable adjustment also results in upward or downward translation of the valve sleeve 106. In turn, this camming action results in upward or downward translation of the shaft 110 with the valve sleeve 106. The arcuate opening 108 may be adjusted to a desired water distribution arc by the user through push down and rotation of the deflector 102.

As shown in FIGS. 2-4, the valve sleeve 106 has a generally cylindrical shape. The valve sleeve 106 includes a central hub defining a bore therethrough for insertion of the shaft 110. The downward biasing force of spring 112 against shaft 110 results in a friction press fit between an inclined shoulder of the shaft 110, a retaining washer 122, and a top surface of the valve sleeve 106. The valve sleeve 106 preferably has a top surface defining teeth 124 formed therein for engagement with the deflector teeth 126. The valve sleeve 106 also includes a bottom helical surface 128 that engages and cams against a corresponding helical surface 130 of the nozzle cover 114 to form the arc adjustment valve 104. As shown in FIG. 3, the non-rotating nozzle cover 114 has an internal helical surface 130 that defines approximately one 360 degree helical revolution, or pitch.

The arcuate span of the nozzle 100 is determined by the relative positions of the internal helical surface 130 of the nozzle cover 114 and the complementary external helical surface 128 of the valve sleeve 106, which act together to form the arcuate opening 108. The camming interaction of the valve sleeve 106 with the nozzle cover 114 forms the arcuate opening 108, as shown in FIG. 2, where the arc is open on the right side of the C-C axis. The length of the arcuate opening 108 is determined by push down and rotation of the deflector 102 (which in turn rotates the valve sleeve 106) relative to the non-rotating nozzle cover 114. The valve sleeve 106 may be rotated with respect to the nozzle cover 114 along the complementary helical surfaces through approximately a ¾ helical pitch to raise or lower the valve sleeve 106. The valve sleeve 106 may be rotated through approximately one 270 degree helical pitch with respect to the nozzle cover 114. The valve sleeve 106 may be rotated relative to the nozzle cover 114 to an arc desired by the user and is not limited to discrete arcs, such as quarter-circle and half-circle.

In an initial lowermost position, the valve sleeve 106 is at the lowest point of the helical turn on the nozzle cover 114 and completely obstructs the flow path through the arcuate opening 108. As the valve sleeve 106 is rotated in the clockwise direction, however, the complementary external helical surface 128 of the valve sleeve 106 begins to traverse the helical turn on the internal surface 130 of the nozzle cover 114. As it begins to traverse the helical turn, a portion of the valve sleeve 106 is spaced from the nozzle cover 114 and a gap, or arcuate opening 108, begins to form between the valve sleeve 106 and the nozzle cover 114. This gap, or arcuate opening 108, provides part of the flow path for water flowing through the nozzle 100. The angle of the arcuate opening 108 increases as the valve sleeve 106 is further rotated clockwise and the valve sleeve 106 continues to traverse the helical turn.

When the valve sleeve 106 is rotated counterclockwise, the angle of the arcuate opening 108 is decreased. The complementary external helical surface 128 of the valve sleeve 106 traverses the helical turn in the opposite direction until it reaches the bottom of the helical turn. When the surface 128 of the valve sleeve 106 has traversed the helical turn completely, the arcuate opening 108 is closed and the flow path through the nozzle 100 is completely or almost completely obstructed. It should be evident that the direction of rotation of the valve sleeve 106 for either opening or closing the arcuate opening 108 can be easily reversed, i.e., from clockwise to counterclockwise or vice versa, such as by changing the thread orientation.

As shown in FIG. 2, the nozzle 100 also preferably includes a radius reduction valve 132. The radius reduction valve 132 can be used to selectively set the water flow rate through the nozzle 100, for purposes of regulating the range of throw of the projected water streams. It is adapted for variable setting through use of a rotatable segment 134 located on an outer wall portion of the nozzle 100. It functions as a second valve that can be opened or closed to allow the flow of water through the nozzle 100. Also, a filter 136 is preferably located upstream of the radius reduction valve 132, so that it obstructs passage of sizable particulate and other debris that could otherwise damage the sprinkler components or compromise desired efficacy of the nozzle 100.

As shown in FIG. 2, the radius reduction valve structure preferably includes a nozzle collar 138, a flow control member (preferably in the form of throttle nut 140), and the nozzle cover 114. The nozzle collar 138 is rotatable about the central axis C-C of the nozzle 100. It has an internal engagement surface 142 that engages the throttle nut 140 so that rotation of the nozzle collar 138 results in rotation of the throttle nut 140. The throttle nut 140 also threadedly engages a post 144 of the nozzle cover 114 such that rotation of the throttle nut 140 causes it to move in an axial direction, as described further below. In this manner, rotation of the nozzle collar 138 can be used to move the throttle nut 140 axially closer to and further away from an inlet 118. When the throttle nut 140 is moved closer to the inlet 118, the flow rate is reduced. The axial movement of the throttle nut 140 towards the inlet 118 increasingly pinches the flow through the inlet 118. When the throttle nut 140 is moved further away from the inlet 118, the flow rate is increased. This axial movement allows the user to adjust the effective throw radius of the nozzle 100 without disruption of the streams dispersed by the deflector 102.

As can be seen in FIGS. 2-4, the throttle nut 140 is coupled to the nozzle cover 114. More specifically, the throttle nut 140 is internally threaded for engagement with an externally threaded hollow post 144 at the lower end of the nozzle cover 114. Rotation of the throttle nut 140 causes it to move along the threading in an axial direction. In one preferred form, rotation of the throttle nut 140 in a counterclockwise direction advances the nut 140 towards the inlet 118 and away from the deflector 102. Conversely, rotation of the throttle nut 140 in a clockwise direction causes it to move away from the inlet 118. Although threaded surfaces are shown in the preferred embodiment, it is contemplated that other engagement surfaces could be used to effect axial movement.

In operation, a user may rotate the outer wall of the nozzle collar 138 in a clockwise or counterclockwise direction. As shown in FIGS. 3 and 4, the nozzle cover 114 preferably includes one or more cut-out portions to define one or more access windows to allow rotation of the nozzle collar outer wall. Further, as shown in FIG. 2, the nozzle collar 138, throttle nut 140, and nozzle cover 114 are oriented and spaced to allow the throttle nut 140 to essentially block fluid flow through the inlet 118 or to allow a desired amount of fluid flow through the inlet 118. As can be seen in FIG. 4, the throttle nut 140 preferably has a helical bottom surface 146 for engagement with a corresponding helical surface 148 of a valve seat 150 when fully extended.

Rotation in a counterclockwise direction results in axial movement of the throttle nut 140 toward the inlet 118. Continued rotation results in the throttle nut 140 advancing to the valve seat 150 formed at the inlet 118 for blocking fluid flow. The dimensions of radial tabs 152, 154 of the throttle nut 140 and the splined internal surface 142 of the nozzle collar 138 are preferably selected to provide over-rotation protection. More specifically, the radial tabs 152, 154 are sufficiently flexible such that they slip out of the splined recesses 142 upon over-rotation. Once the inlet 118 is blocked, further rotation of the nozzle collar 138 causes slippage of the radial tabs 152, 154, allowing the collar 138 to continue to rotate without corresponding rotation of the throttle nut 140, which might otherwise cause potential damage to sprinkler components.

Rotation in a clockwise direction causes the throttle nut 140 to move axially away from the inlet 118. Continued rotation allows an increasing amount of fluid flow through the inlet 118, and the nozzle collar 138 may be rotated to the desired amount of fluid flow. When the valve is open, fluid flows through the nozzle 100 along the following flow path: through the inlet 118, between the nozzle collar 138 and the throttle nut 140 and through valve 132, between ribs 156 of the nozzle cover 114, through the arcuate opening 108 (if set to an angle greater than 0 degrees), upwardly along the upper cylindrical wall of the nozzle cover 114, to the underside surface of the deflector 102, and radially outwardly from the deflector 102. It should be evident that the direction of rotation of the outer wall for axial movement of the throttle nut 140 can be easily reversed, i.e., from clockwise to counterclockwise or vice versa.

Figure 5:
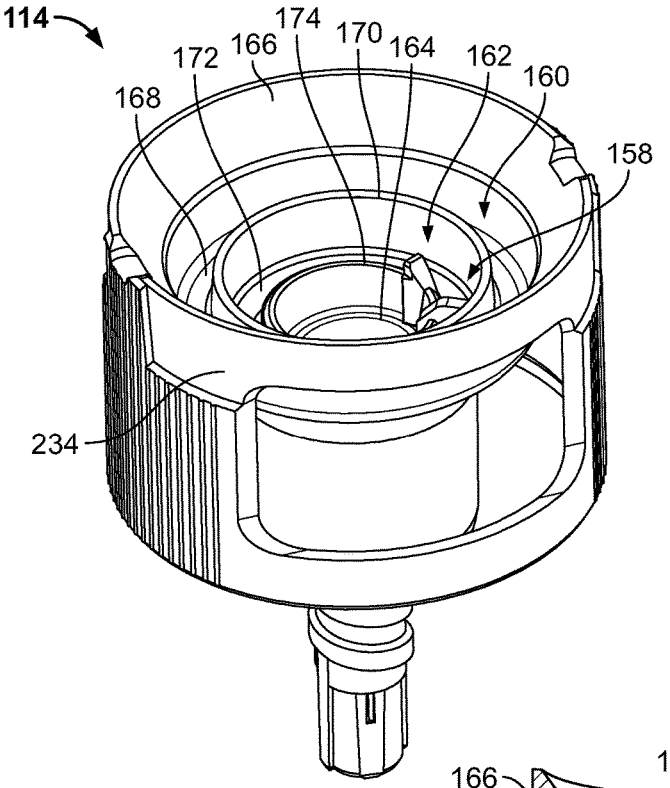
FIG. 5 is a top perspective view of the nozzle cover of the nozzle of FIG. 1.
Figure 6:
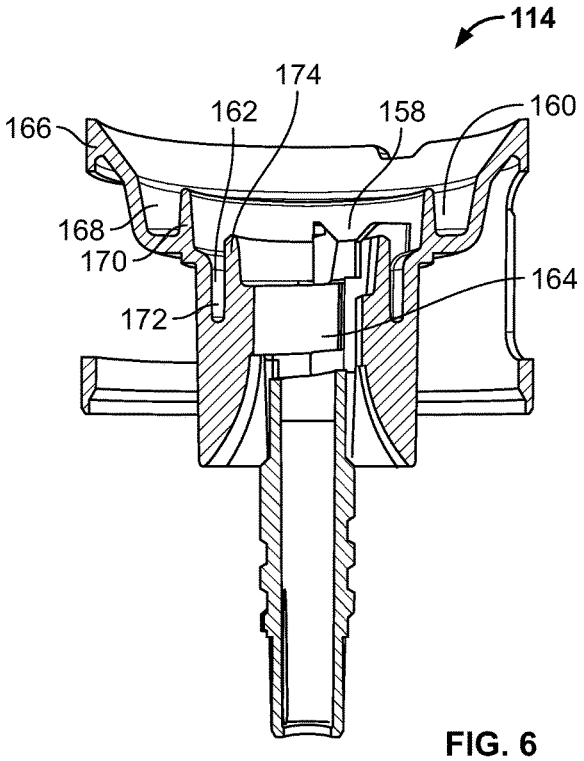
FIG. 6 is a cross-sectional view of the nozzle cover of the nozzle of FIG. 1.

The nozzle 100 may also include features to prevent grit and other debris from entering into sensitive areas of the nozzle 100, which may affect or even prevent operation of the nozzle 100. For example, as shown in FIGS. 5 and 6, an upward facing surface 158 of the nozzle cover 114 includes two "debris traps" 160, 162 that limit debris from becoming lodged in the central hub 164 of the nozzle cover 114. As can be seen, this central hub 164 of the nozzle cover 114 defines a recess for the nesting insertion of the valve sleeve 106, and the nozzle cover 114 and valve sleeve 106 are the two valve bodies that define the arc adjustment valve 104. Accordingly, if debris becomes lodged in the central hub 164 of the nozzle cover 114, it may interfere with rotation of the valve sleeve 106, may block a portion of the arcuate valve 104, or may affect sealing between the valve bodies 106, 114 (e.g., the closed portion of the valve 104). In one form, without debris traps 160, 162, the back flow of grit, debris, or other particulate matter into the nozzle cover 114 may result in such debris being sucked into the central hub 164 and/or valve sleeve 106.

The first debris trap 160 is defined, in part, by the outer wall 166 of the nozzle cover 114. As can be seen, the outer wall 166 is inclined at an angle such that the outermost portion is at a higher elevation than the innermost portion. During normal operation, when grit, dirt, or other debris comes into contact with this outer wall 166, it may be guided into a first channel (or first annular depression) 168. The debris is prevented from moving from this first channel 168 and entering the central hub 164 by an intermediate wall 170. In other words, the debris trap 160 is defined, in part, by the outer wall 166, first channel 168, and intermediate wall 170 such that debris is trapped in the first channel 168. As shown in FIGS. 5 and 6, the second debris trap 162 includes a second channel 172 (or second annular depression) disposed between the intermediate wall 170 and an inner wall 174. In other words, the debris traps 160, 162 may include two separate annular channels 168, 172, respectively, for capturing debris before it enters the central hub 164.

As stated, one way in which debris may accumulate is from back flow or back siphoning when water stops flowing through the nozzle 100 (i.e., the sprinkler is turned off). One purpose of the debris traps 160, 162 is to block this back flow or back siphoning from depositing debris in the central hub 164 of the nozzle cover 114 and/or valve sleeve 106 so as to possibly interfere with the arc adjustment operation. As is evident, nozzles 100 are subject to external contaminants during operation. Adding walls/barriers and channels to trap and prevent debris from reaching the arc valve portion of the nozzle 100 helps ensure effective operation of the nozzle 100.

In addition, in one form, the nozzle 100 may be mounted in a "pop-up" sprinkler assembly 200. One example of such a pop-up sprinkler assembly 200 is shown in FIGS. 7 and 8. The pop-up sprinkler assembly 200 described and shown herein is one exemplary type of assembly that may be used with the nozzle 100. The assembly 200 and many of its components are similar to that shown and described in U.S. Pat. No. 6,997,393 and U.S. Pat. No. 8,833,672, which have been assigned to the assignee of the present application and which are incorporated by reference herein in their entirety. Other similar types of pop-up sprinklers and components are shown and described in U.S. Pat. Nos. 4,479,611 and 4,913,352, which also have been assigned to the assignee of the present application and which are also incorporated by reference herein in their entirety. As should be evident, various other types of sprinkler assemblies also may incorporate nozzle 100.

As shown in FIGS. 7 and 8, the sprinkler assembly 200 generally includes a housing 202 and a riser assembly 204. The riser assembly 204 travels cyclically between a spring-retracted position and an elevated spraying position in response to water pressure. More specifically, when the supply water is on, i.e., pressurized for a watering cycle, the riser assembly 204 extends ("pops up") above ground level so that water can be distributed to the terrain for irrigation. When the water is shut off at the end of a watering cycle, the riser assembly 204 retracts into the housing 202 where it is protected from damage. FIGS. 7 and 8 show the riser assembly 204 in a retracted position.

The housing 202 provides a protective covering for the riser assembly 204 and, together with the riser assembly 204, serves as a conduit for incoming water under pressure. The housing 202 preferably has a generally cylindrical shape and is preferably made of a sturdy lightweight injection molded plastic or similar material, suitable for underground installation with the upper end 206 disposed substantially flush with the surface of the soil. The housing 202 preferably has a lower end 208 with an inlet 210 that is threaded to connect to a correspondingly threaded outlet of a water supply pipe (not shown).

In one preferred form, the riser assembly 204 includes a stem 212 with a lower end 214 and an upper end, or nozzle mounting portion, 216. The stem 212 is preferably cylindrical in shape and is preferably made of a lightweight molded plastic or similar material. The riser assembly 204 has a threaded upper end 218 for attaching to the nozzle 100. The nozzle 100 ejects water outwardly from the sprinkler 200 when the riser assembly 204 is in the elevated spray position.

A spring 220 for retracting the riser assembly 204 is preferably disposed in the housing 202 about the outside surface 222 of the stem 212. The spring 220 has a bottom coil 224 that engages a guide 226 and an upper coil 228 seated against the inside of a housing cover 230. The spring 220 biases the riser assembly 204 toward the retracted position until the water pressure reaches a predetermined threshold pressure. An example of a threshold pressure is about 5 psi, at which time the water supply pressure acting on riser assembly 204 would be sufficient to overcome the force of the spring 220 and cause movement of the riser assembly 204 to the elevated spraying position.

The housing cover 230 serves to minimize the introduction of dirt and other debris into the housing 202. The housing cover 230 preferably has internal threads and is mounted to the upper end 206 of the housing 202 which has corresponding threads. The cover 230 has a central opening through which the elongated riser assembly 204 is movable between the retracted position and the elevated spraying position. The housing cover 230 is also preferably fitted with a seal 232, preferably a wiper seal, mounted on the inside of the cover 230.

In one form, the nozzle cover 114 has a reduced outer diameter that forms another sort of debris prevention feature. More specifically, as can be seen in FIG. 5, the nozzle cover 114 includes a reduced diameter portion 234 (or indented portion) near the top of the nozzle cover 114. As can be seen from FIG. 8, this reduced diameter portion 234 increases the gap 236 between the nozzle cover 114 and the seal 232, thereby creating a larger flow path around the nozzle 100.

The nozzle 100 is exposed to external contaminants during operation. It is believed that reducing the outside diameter of the nozzle cover 114 creates an alternative path for the back flow of water and debris. Adding an alternative reverse flow path reduces the likelihood of debris flowing into the nozzle 100 and reaching the arc valve portion of the nozzle 100.

Figure 9:
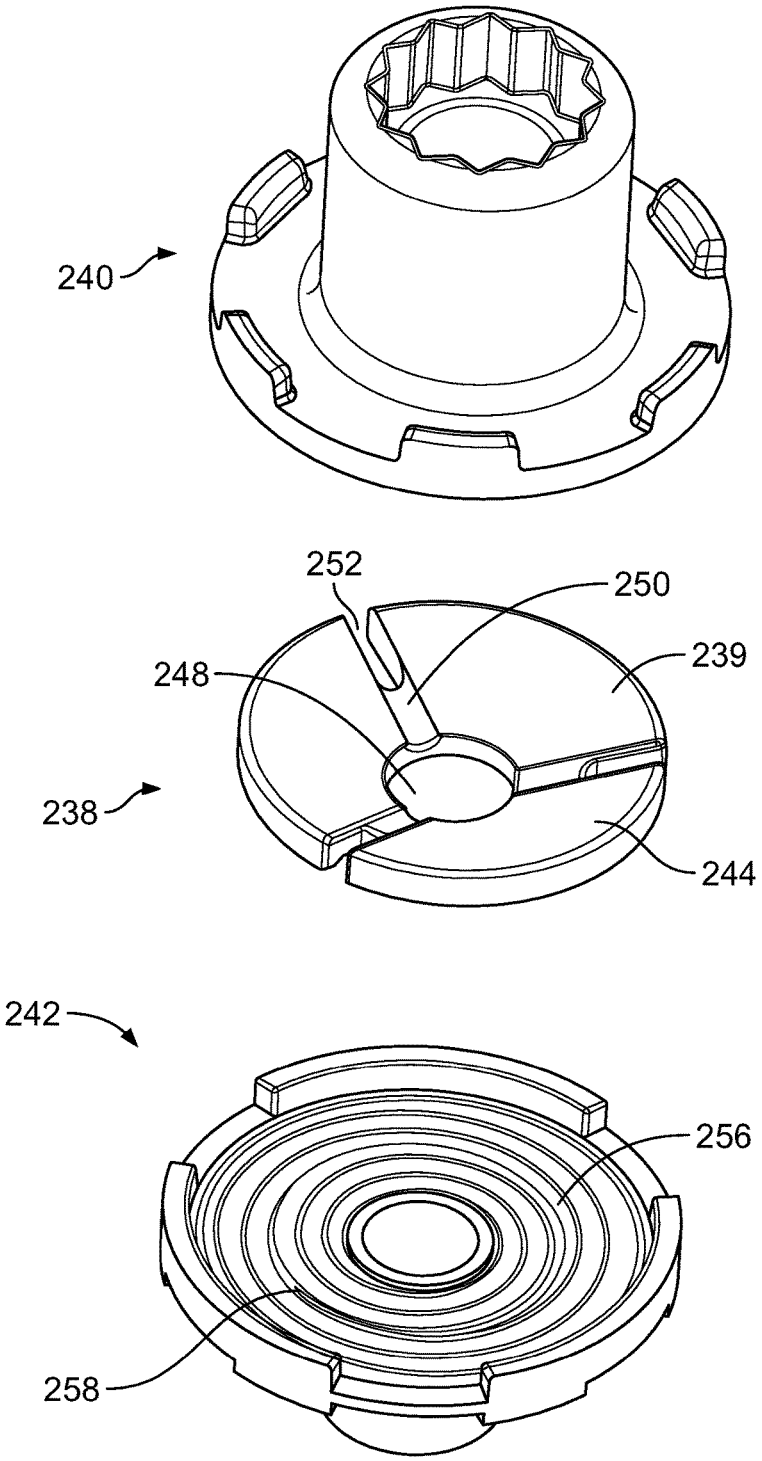
FIG. 9 is a top perspective view of the friction disk, brake pad, and seal retainer of the nozzle of FIG. 1.
Figure 10:
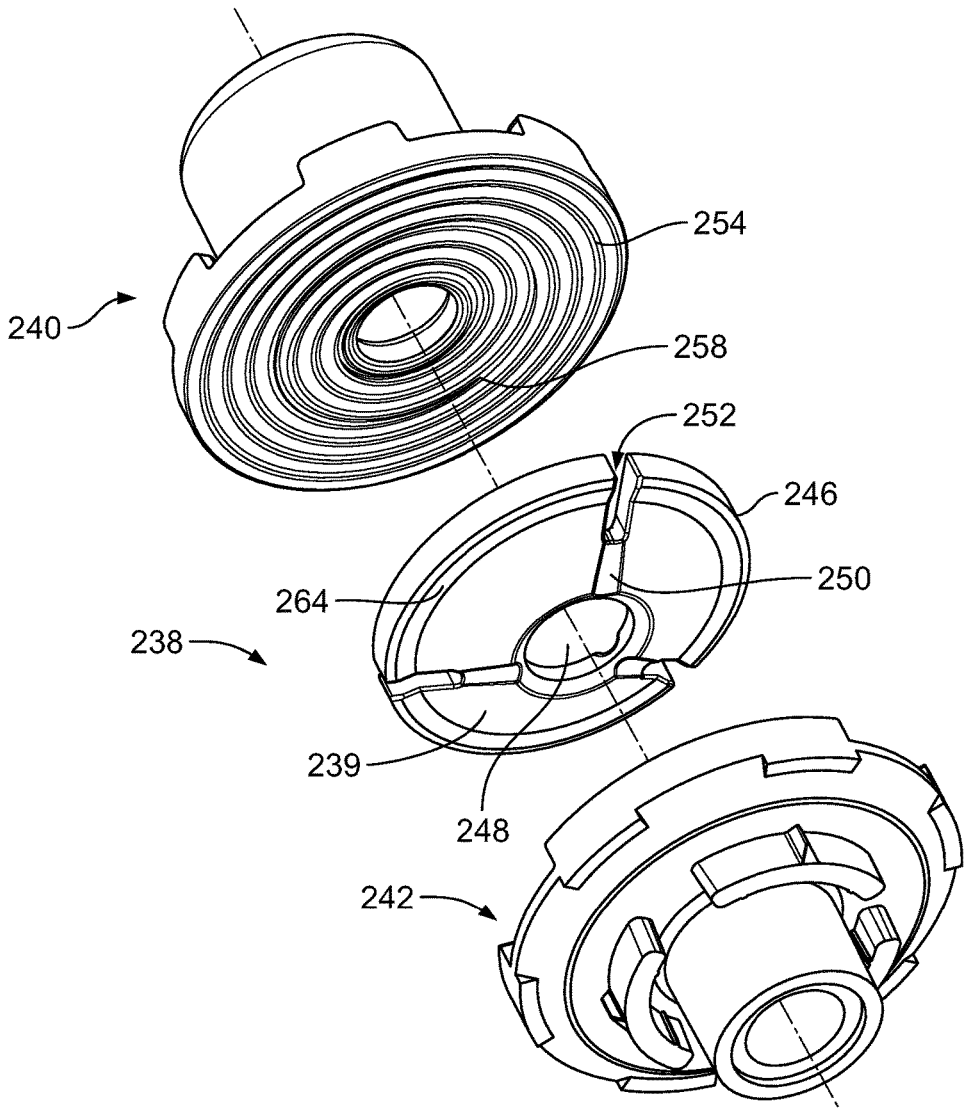
FIG. 10 is a bottom perspective view of the friction disk, brake pad, and seal retainer of the nozzle of FIG. 1.
Figure 11:
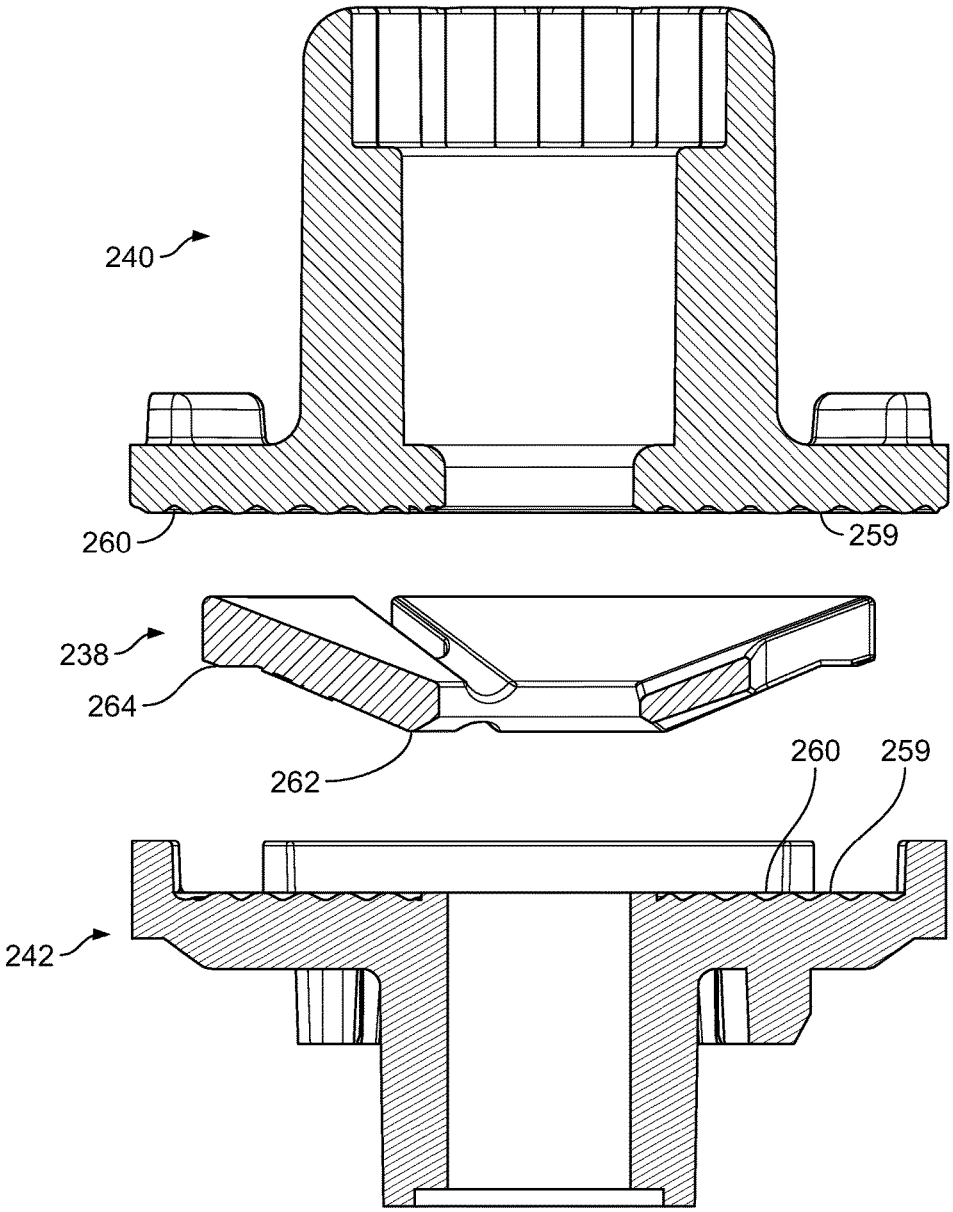
FIG. 11 is a cross-sectional view of the friction disk, brake pad, and seal retainer of the nozzle of FIG. 1.
Figure 13:
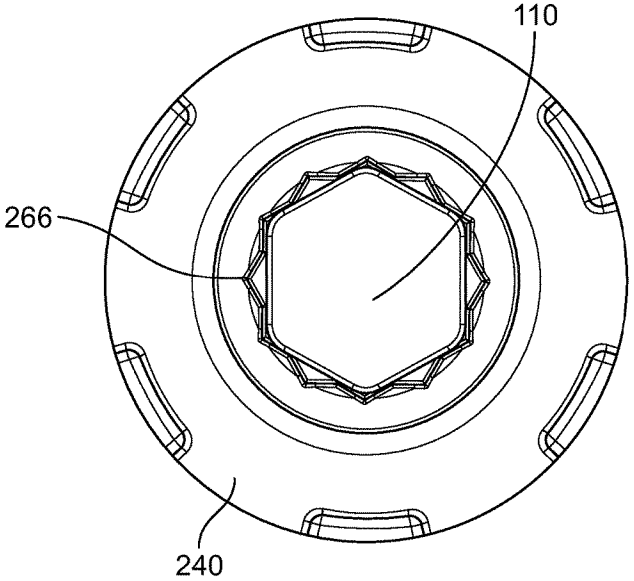
FIG. 13 is a top plan view of the shaft within the friction disk of the nozzle of FIG. 1.

Further, the nozzle 100 includes braking features to maintain relatively consistent braking under various conditions. As can be seen in FIGS. 9-11, nozzle 100 includes a frustoconical brake pad 238. The brake pad 238 is part of a brake disposed in the deflector 102, which maintains the rotation of the deflector 102 at a relatively constant speed irrespective of flow rate, fluid pressure, and temperature. The brake includes the brake pad 238 sandwiched between a friction disk 240 (above the brake pad 238) and a seal retainer 242 (below the brake pad 238). During operation of the nozzle 100, the friction disk 240 is held relatively stationary by the shaft 110, the seal retainer 242 rotates with the deflector 102 at a first rate, and the brake pad 238 rotates at a second, intermediate rate. Further, during operation, the seal retainer 242 is urged upwardly against the brake pad 238, which results in a variable frictional resistance that maintains a relatively constant rotational speed of the deflector 102 irrespective of the rate of fluid flow, fluid pressure, and/or operating temperature.

As can be seen in FIGS. 9-11, the brake pad 238 is generally frustoconical in shape and includes a top surface 244 and a bottom surface 246. The frustoconical shape is inverted as shown in the figures and includes a central bore 248 for insertion of the shaft 110. The top and bottom surfaces 244, 246 each include three radial grooves 250 spaced equidistantly about the surfaces and preferably having a uniform width. These radial grooves 250 extend radially outwardly from the central bore 248 about halfway to the outer perimeter. These grooves 250 help distribute lubrication (or grease) over the surface of the brake pad 238.

The brake pad 238 also includes a feature that allows it to provide sufficient braking at low power input. More specifically, as can be seen in FIGS. 9 and 10, the brake pad 238 includes three radially extending slots 252 that continue outwardly in the direction of the three radial grooves 250. In other words, each radial groove 250 terminates in a radial slot 252. It has been found that these three radial slots 252 allow the brake pad 238 to act like three separate, cantilevered brake pad bodies and make the brake pad 238 less stiff. This design allows part of the brake pad 238 to begin to flatten at lower loads than previous designs. More specifically, at low power input, a conical design without the slots 252 may not tend to collapse (or flatten) enough to cause sufficient braking, so the deflector 102 may be rotating too fast. In contrast, the outer annular portion 239 of the split brake pad 238 defined by the slots 252 tends to flatten easier and the brake pad 238 stiffness is reduced, thereby causing braking sooner at low power input.

The brake includes another feature intended to help distribute lubrication (or grease) more uniformly over the top and bottom surfaces 244, 246 of the brake pad 238. The friction disk 240 and seal retainer 242 each include raised spiral surfaces that engage and interact with the brake pad 238. More specifically, the bottom of the friction disk 240 defines a first, raised spiral surface 254 that engages the top surface 244 of the brake pad 238, and the top of the seal retainer 242 defines a second, raised spiral surface 256 that engages the bottom surface 246 of the brake pad 238. Depending on the orientation of the spiral surfaces 254, 256, i.e., clockwise or counterclockwise, and the direction of rotation of the deflector 102, these spiral surfaces 254, 256 have been found to help distribute grease deposited at inner or outer margins of the spiral pattern to the rest of the spiral pattern.

Further, in one form, each spiraled surface 254, 256 is preferably a "double spiraled surface" that initially spirals in a first direction, i.e., clockwise, as the spiral moves inwardly, and then, near a halfway transition point 258, spirals in the reverse direction, i.e., counter-clockwise, as the spiral continues to move inwardly. The grease is initially deposited as several dots near the middle of the double spiraled pattern, and during rotation of the deflector 102, it is distributed both inwardly and outwardly toward both the inner and outer margins. This double spiraled surface tends to distribute lubricant uniformly to both the inner and outer portions of the brake pad 238.

The brake pad 238 is preferably formed from a rubber material and coated with a lubricant, such as a thin layer of a selected grease, to provide a relatively controlled coefficient of friction. The spiraled surfaces 254, 256 help distribute the lubricant over the entire top and bottom faces of the brake pad 238. By ensuring more uniform lubrication, the spiraled surfaces 254, 256 assist with proper braking at both low and high power input. The power input is determined generally by fluid pressure and flow rate and corresponds generally to the rotational torque directed against the deflector 102 by the impacting fluid.

The spiraled surfaces 254, 256 define crests 259 and troughs 260 with troughs 260 acting as reservoirs for receiving lubricant. More specifically, the troughs 260 act as reservoirs for the lubricant to help ensure a minimum grease film thickness. Without the spiraled surfaces 254, 256 (i.e., the surfaces are flat), the grease film thickness can approach zero, and it has been found that this minute thickness can result in excessive braking, especially for high power input. In contrast, it is believed that the spiraled surfaces 254, 256 provide a higher minimum thickness. The minimum grease film thickness will generally be on the order of (or slightly less than) the distance between the crests 259 and troughs 260 of the spiraled surfaces 254, 256.

Thus, at very low power input, the brake pad 238 generally retains its conical shape, and the seal retainer 242 is urged slightly upwardly against the bottom surface 246 of the brake pad 238. The seal retainer 242 engages the brake pad 238 at a relatively thin inner annular portion 262 of the brake pad 238 and provides relatively little braking at very low power input. As the power input increases slightly, the three radial slots 252 in the brake pad 238 cause the outer annular portion 239 of the brake pad 238 to flatten such that more surface area is in engagement, friction increases, and braking increases.

In addition, the reverse spiral surfaces 254, 256 provide relatively uniform lubrication of the brake pad 238 to make sure that the friction does not become excessive at high power input. At high power input, when there is significant frictional engagement between the brake pad 238 and other braking components, there may be too much braking, which may lead the nozzle 100 to stall. In other words, without sufficient grease thickness, the brake pad 238 may tend to cause too much friction at high power input.

At high power input, the thick outermost annular lip 264 is sandwiched between the friction disk 240 and seal retainer 242, and most of the friction (and braking) results from the engagement of the thick outer lip 264 with the seal retainer 242. However, as addressed, it has been found that there is more braking at high power input than would be anticipated, and it is believed that this excessive braking may result from a change in grease thickness at high power input. More specifically, it is believed that the grease viscosity may be reduced (i.e., the grease becomes spread too thin) at high power input, resulting in too much friction, too much braking, and an overly reduced deflector rotational speed.

The spiraled surfaces 254, 256 on the friction disk 240 and seal retainer 242 assist in avoiding excessive braking at high power input. More specifically, the troughs 260 form a reservoir for the grease, so as to limit the minimum film thickness of the grease with the minimum film thickness being generally about the distance between a crest 259 and a trough 260. It is believed that this minimum film thickness increases lubrication and thereby limits the excessive braking and unexpected slowing of the deflector 102 at high power input.

Figure 12:
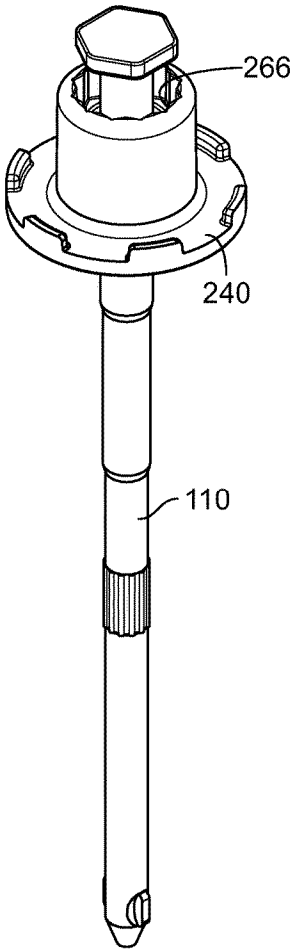
FIG. 12 is a top perspective view of the shaft within the friction disk of the nozzle of FIG. 1.

As shown in FIG. 12, the friction disk 240 includes another feature that helps with adjustment of the arc adjustment valve 104. More specifically, an inner diameter 266 of the friction disk 240 is in the form of a twelve-pointed star, or twenty four sided polygon. The inner diameter 266 of the friction disk 240 cooperates with the shaft 110 during arc adjustment. As shown in FIG. 12, the six-sided (hexagonal) top of the shaft 110 is seated within the twelve-pointed recess defined by the inner diameter 266.

It has been found that the twelve-pointed star arrangement assists with indexing of the six-pointed shaft 110 during manufacturing and assembly. In other words, it helps align the friction disk 240 with the shaft 110 during assembly. Also, following assembly and during operation, the twelve-pointed star arrangement may help with alignment of these two components. If, for some reason, the top of the friction disk 240 and the top of the shaft 110 become out of engagement during operation, this arrangement helps with realignment by providing more positions for realignment. In other words, by increasing the friction disk inside diameter 266 from six points to twelve points, the likelihood of indexing to the shaft six-point shape is increased.

Figure 14:
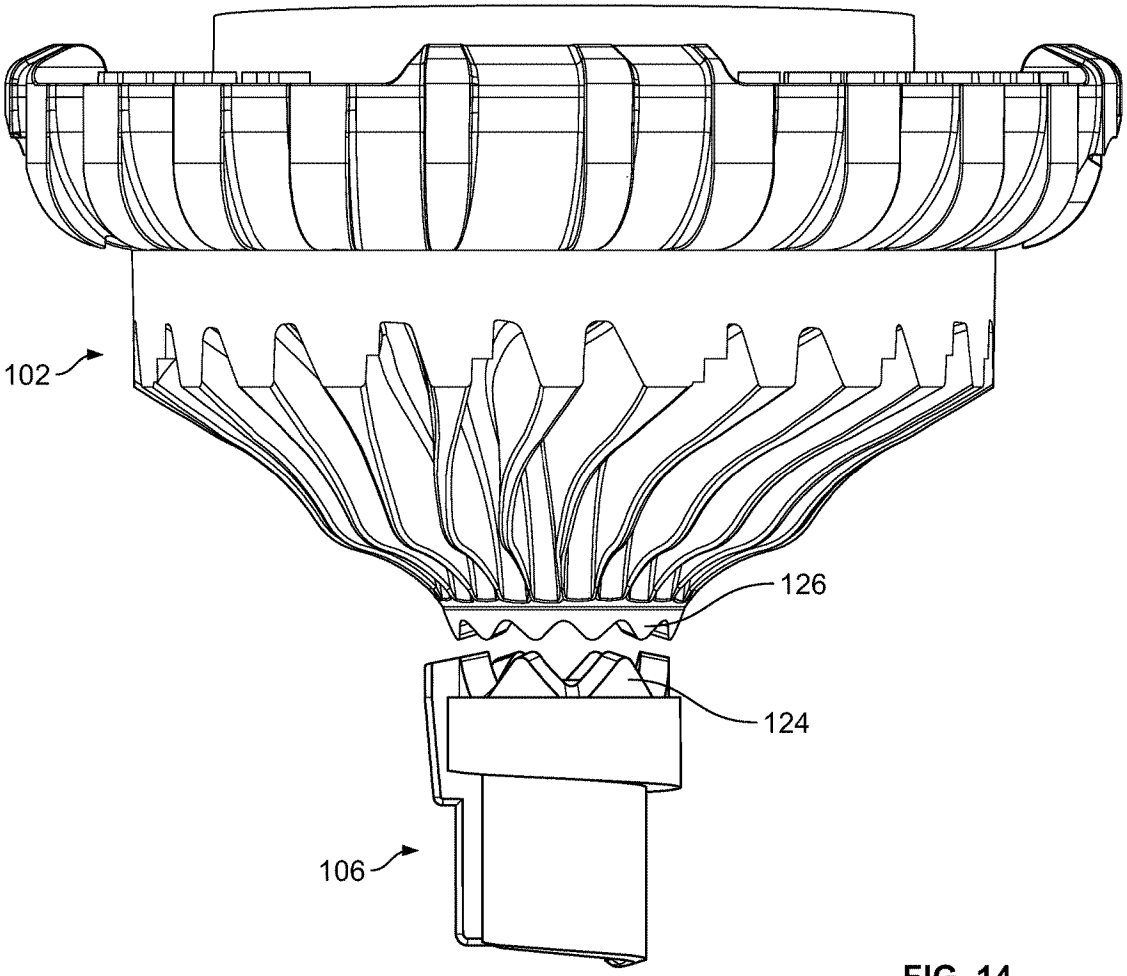
FIG. 14 is a side perspective view of the deflector and the valve sleeve of the nozzle of FIG. 1.

As shown in FIG. 14, the deflector 102 and valve sleeve 106 include an engagement feature that helps with arc adjustment. More specifically, the deflector 102 includes twelve downwardly-facing teeth 126 that engage six upwardly-facing teeth 124 of the valve sleeve 106. As can be seen, the number and arrangement of teeth are mismatched. Also, the twelve downwardly-facing teeth 126 of the deflector 102 are shallower (shorter in height) than the six upwardly-facing teeth 124 of the valve sleeve 106. With these shallower deflector teeth 126, the distance between the deflector teeth 126 and the valve sleeve teeth 124 can be reduced. In other words, the deflector 102 need not travel as far (i.e., need not be pushed down as far by a user) so that the teeth engage one another to adjust the arcuate setting.

This arrangement reduces the required lift to disengage the teeth 124, 126 from one another. This reduced lift may be desirable when the force exerted by upwardly directed water to lift the deflector 102 is limited (such as under low water flow conditions). Otherwise, under such conditions, the deflector 102 may not have sufficient clearance to rotate without interference by the teeth 124, 126 with one another. Also, the tips of the deflector and/or valve teeth 124, 126 may be truncated to provide additional clearance.

Further, it has been found that this engagement feature helps prevent the accumulation of debris and other particulate matter on and about the valve sleeve 106. The presence of debris or particulates in the engagement feature (i.e., teeth 124, 126) can lead to damage to the deflector 102 or valve sleeve 106 when engaged. When a user depresses the deflector 102 to cause the corresponding teeth to engage, it can be seen that a gap (or a void) will be formed between the teeth 124, 126. In other words, because the deflector teeth 126 are shallower than the valve sleeve teeth 124, the deflector teeth 126 will not completely fill the troughs between adjacent valve sleeve teeth 124 during engagement. The void between engaging teeth 124, 126 creates a relief for debris to occupy during engagement, thereby improving debris tolerance.

Figure 15:
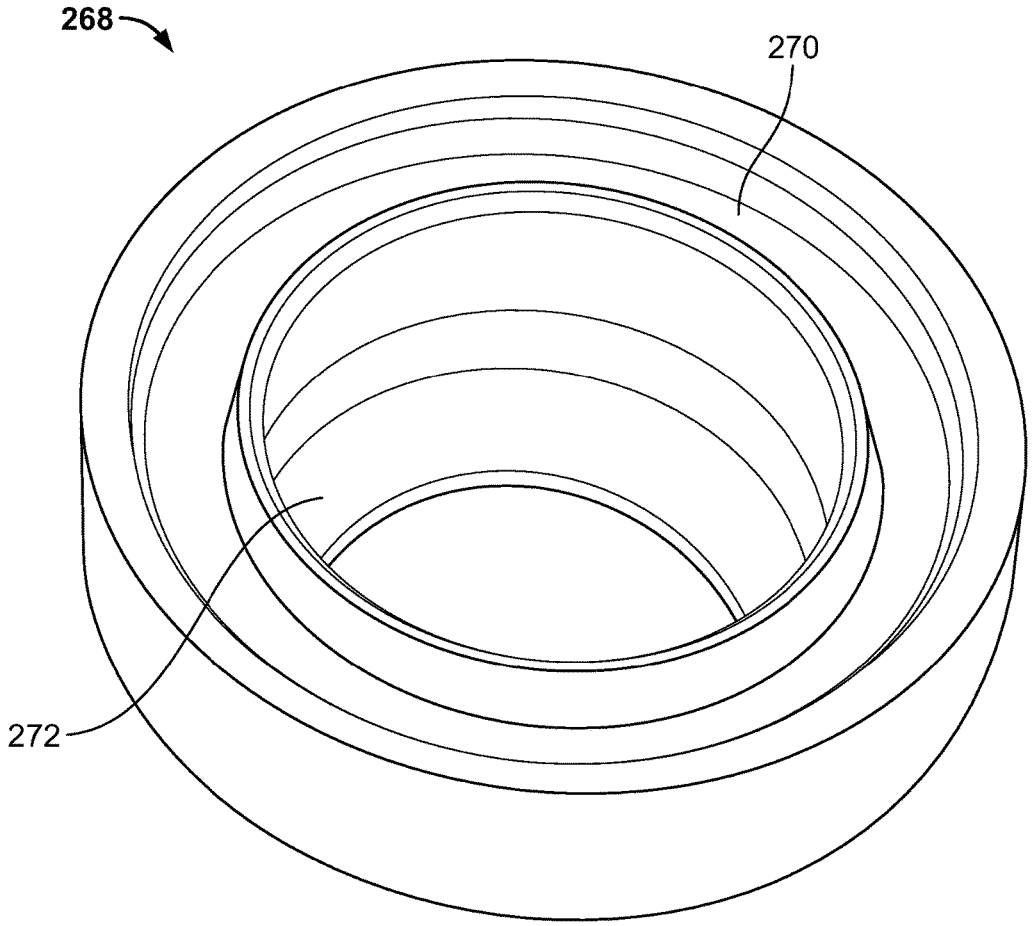
FIG. 15 is a top perspective view of a deflector lip seal of the nozzle of FIG. 1.
Figure 16:
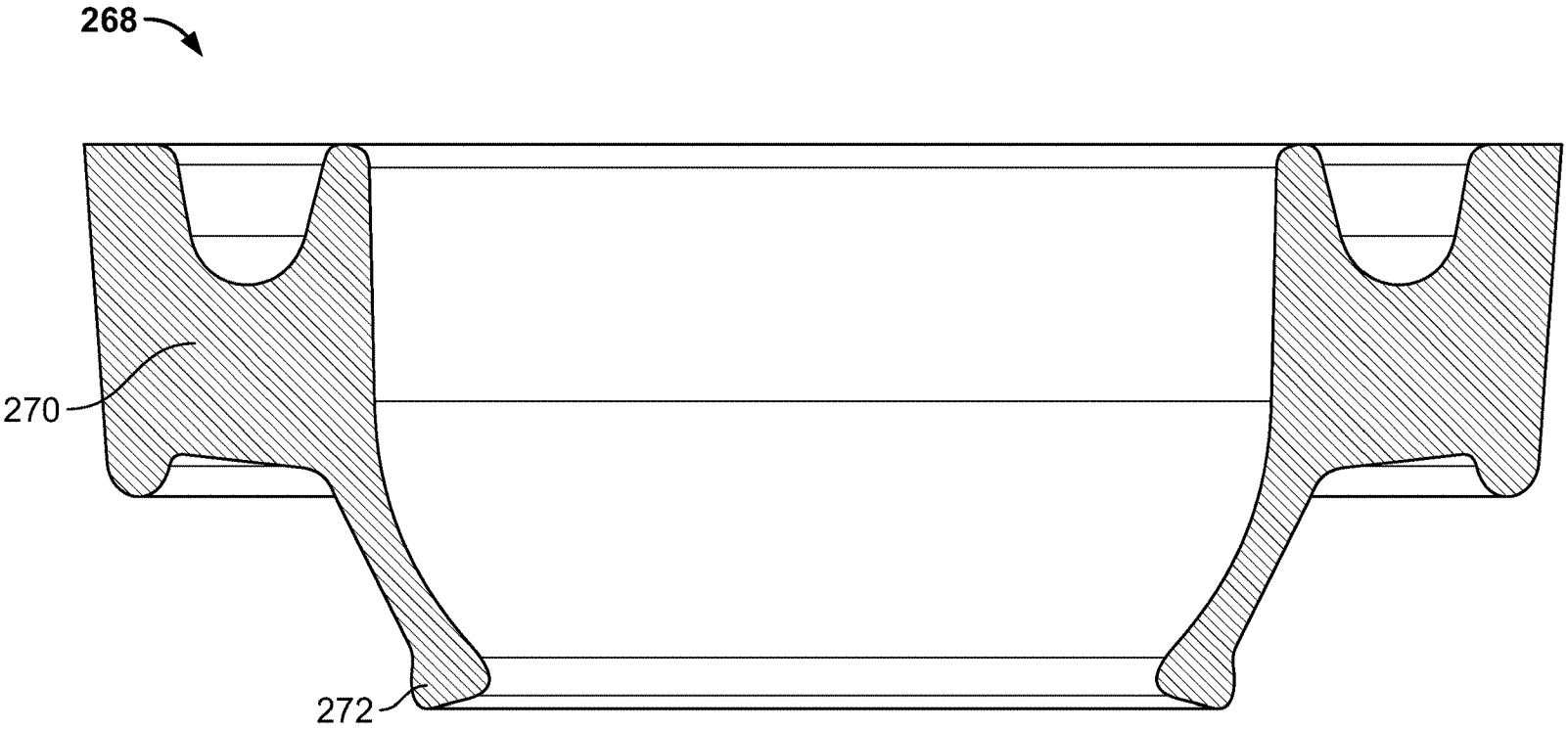
FIG. 16 is a cross-sectional view of the deflector lip seal of FIG. 15.
Figure 17:
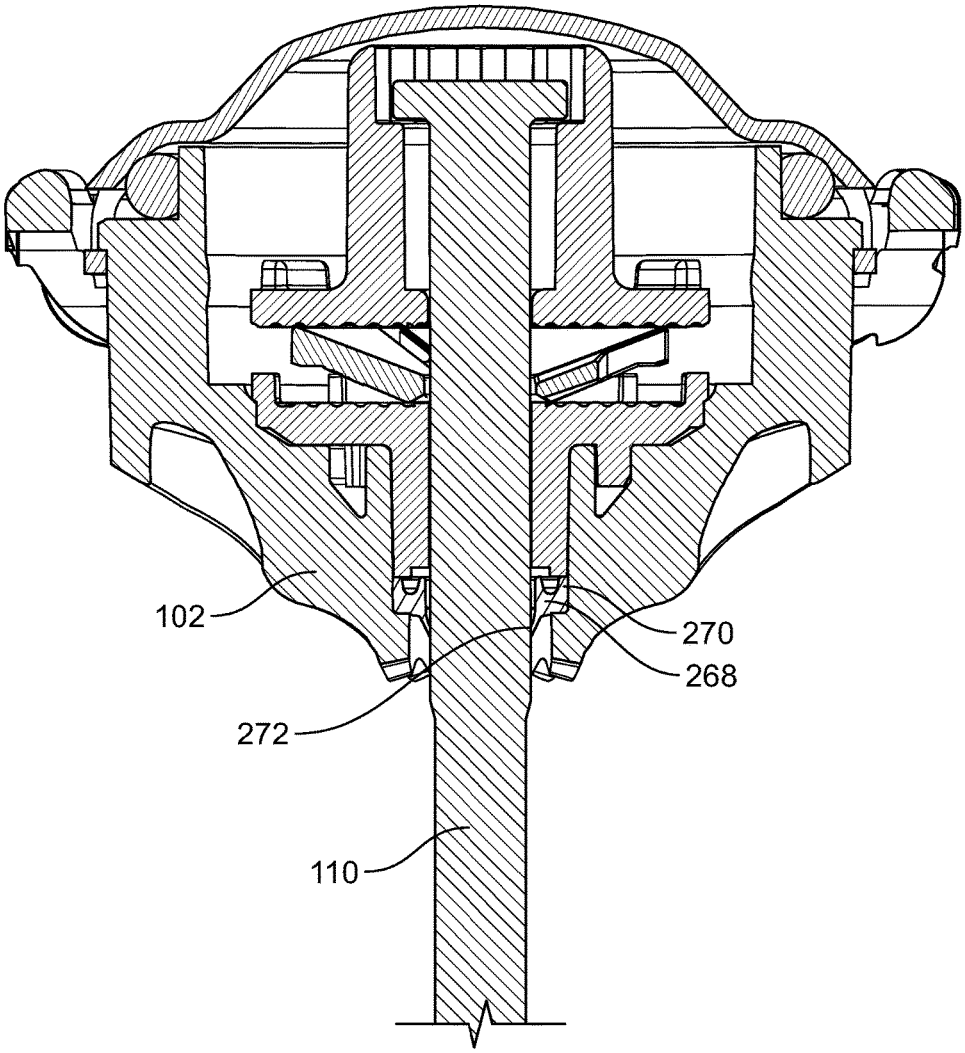
FIG. 17 is a partial cross-sectional view of the nozzle of FIG. 1.

As shown in FIGS. 15-17, the nozzle 100 includes a seal feature that helps limit excessive friction as the deflector 102 is rotating during irrigation. More specifically, as shown in FIGS. 15 and 16, the nozzle 100 includes a single lip deflector seal 268 that seals the interior of the deflector 102 from upwardly-directed fluid while also minimizing the amount of friction during deflector rotation. The seal 268 includes an annular top portion 270 that is mounted near the bottom end of the deflector 102, which causes the seal 268 to rotate with the deflector 102. The seal 268 further includes an inwardly extending lip 272 that blocks water directed upwardly through the nozzle 100 from the interior of the deflector 102. Thus, the seal 268 keeps water and debris from entering the brake/speed control assembly.

The seal 268 is designed so that only a small portion of the seal 268 comes into contact with the shaft 110 during irrigation. As can be seen, the lip 272 has a smaller inner diameter than the annular top portion 270 so that only the lip 272 circumferentially engages the shaft 110. During irrigation, the seal 268 is rotating with the deflector 102, and contact by the seal with the stationary shaft 110 results in friction. A portion of the lip 272 comes into contact with the shaft 110 in order to seal against the shaft 110, but this portion is minimized in order to reduce the amount of friction caused by the seal 268. If the friction is excessive, this may interfere with the operation of the deflector 102 and with the brake, especially at low power input settings where seal friction may have a proportionately large impact on the relatively slow rotation of the deflector 102. In addition, the lip 272 provides an effective seal because it fits snugly about the entire circumference of the shaft 110 (i.e., there is good interference with the shaft 110). This circumferential arrangement also helps the seal 268 resist opening a gap due to side load forces acting against the deflector 102.

It will be understood that various changes in the details, materials, and arrangements of parts and components which have been herein described and illustrated in order to explain the nature of the nozzle may be made by those skilled in the art within the principle and scope of the subject matter as expressed in the appended claims. Furthermore, while various features have been described with regard to a particular embodiment or a particular approach, it will be appreciated that features described for one embodiment also may be incorporated with the other described embodiments.

What is claimed is:

1. A nozzle comprising:

a rotatable deflector having an underside surface contoured to deliver fluid radially outwardly therefrom;

a nozzle body defining an inlet and an outlet, the inlet configured to received fluid from a source and the outlet configured to deliver fluid to the underside surface of the deflector to cause rotation of the deflector;

a brake disposed within the deflector configured to reduce the rotational speed of the deflector, the brake comprising a first brake body that rotates with the deflector, a second brake body that is fixed against the rotation, and a brake pad disposed between and engaging the first brake body and the second brake body;

wherein the brake pad is frustoconical in shape when the deflector is not rotating, the brake pad including a top surface and a bottom surface; and wherein the brake pad includes at least one slot extending through a first portion of the brake pad, the at least one slot extending through the brake pad and the top surface and the bottom surface and configured to cause the brake pad to flatten when the deflector is rotating.

2. The nozzle of claim 1, wherein the first brake body includes a first spiral surface configured to distribute lubricant on one of the top and bottom surfaces of the brake pad.

3. The nozzle of claim 2, wherein the second brake body includes a second spiral surface configured to distribute lubricant on the other of the top and bottom surfaces of the brake pad.

4. The nozzle of claim 3, wherein at least one of the first spiral surface and the second spiral surface is a double spiral surface that initially spirals in a first direction as the spiral moves inwardly along the first or second spiral surface and then spirals in the second, reverse direction as the spiral continues to move inwardly along the first or second spiral surface.

5. The nozzle of claim 1, wherein the at least one slot extending through a first portion of the brake pad is aligned with a first groove on one of the top and bottom surfaces of the brake pad.

6. The nozzle of claim 5, wherein the at least one slot extending through a first portion of the brake pad is aligned with a second groove on the other of the top and bottom surfaces of the brake pad, the first and second grooves extending in the same direction as the at least one slot.

7. The nozzle of claim 6, wherein the at least one slot comprises three slots spaced equidistantly about the brake pad and wherein the brake pad comprises three sets of first and second grooves, each slot aligned in the same direction as one set of first and second grooves.

8. The nozzle of claim 1 further comprising a shaft supporting the rotatable deflector, wherein the first brake body, the second brake body, and the brake pad each define bores configured to receive the shaft therethrough.

9. The nozzle of claim 8, wherein:

the shaft comprises a first top portion defining a first polygon;

the second brake body comprises a second top portion defining a second polygon with a different number of sides than the first polygon; and the first top portion is received within the second top portion.

10. The nozzle of claim 8, further comprising a seal mounted at the deflector, the seal including a lip portion circumferentially engaging the shaft at exactly one circumferential position to block fluid exiting the outlet from entering an interior of the deflector.

11. A nozzle comprising:

a rotatable deflector having an underside surface contoured to deliver fluid radially outwardly therefrom;

a nozzle body defining an inlet and an outlet, the inlet configured to received fluid from a source and the outlet configured to deliver fluid to the underside surface of the deflector to cause rotation of the deflector;

an arc adjustment valve being adjustable to change an arcuate opening for the distribution of fluid from the deflector within a predetermined arcuate coverage, the valve comprising a first valve body and a second valve body configured to engage one another to adjust the arcuate opening;

wherein the second valve body includes a first debris trap comprising a first wall and a second wall defining a first channel therebetween, the first debris trap configured to limit debris from flowing into the arc adjustment valve;

a second debris trap and a third wall, the second debris trap comprising the second and third walls defining a second channel therebetween to limit debris from flowing into the arc adjustment valve.

12. The nozzle of claim 11, wherein the first valve body is configured for nested insertion within a central hub of the second valve body, and wherein the central hub of the second valve body is disposed radially inwardly from the first, second, and third walls of the first and second debris traps.

13. The nozzle of claim 11, wherein the first wall has an outer portion inclined at an angle such that a first, outermost portion is at a higher elevation than a second, innermost portion.

14. The nozzle of claim 11, wherein the first valve body defines a first helical surface and the second valve body defines a second helical surface, the first and second helical surfaces being moveable with respect to one another for setting the length of the arcuate opening.

15. A nozzle comprising:

a rotatable deflector having an underside surface contoured to deliver fluid radially outwardly therefrom, the deflector moveable between an operational position and an adjustment position;

a nozzle body defining an inlet and an outlet, the inlet configured to received fluid from a source and the outlet configured to deliver fluid to the underside surface of the deflector to cause rotation of the deflector in the operational position;

an arc adjustment valve being adjustable to change an arcuate opening for the distribution of fluid from the deflector within a predetermined arcuate coverage, the valve comprising a first valve body and a second valve body configured to engage one another to adjust the arcuate opening;

wherein the deflector is adapted for engagement with the first valve body for setting a length of the arcuate opening in the adjustment position and wherein the deflector is adapted for irrigation in the operational position; and wherein the deflector includes a first set of teeth of a first height and the first valve body includes a second set of teeth of a second height, the first height being different than the second height, the two sets of teeth engaging one another for setting the length of the arcuate opening.

16. The nozzle of claim 15, wherein the first height is less than the second height.

17. The nozzle of claim 15, wherein the first set of teeth includes a different number of teeth than the second set of teeth.

18. The nozzle of claim 15, wherein the first set of teeth includes twice as many teeth as the second set of teeth.

19. The nozzle of claim 15, wherein the first set of teeth and the second set of teeth define at least one gap therebetween when the first and second set of teeth are in engagement.

* * * * *